US011024455B2

(12) United States Patent
Sekiguchi et al.

(10) Patent No.: US 11,024,455 B2
(45) Date of Patent: Jun. 1, 2021

(54) COIL COMPONENT

(71) Applicant: Taiyo Yuden Co., Ltd., Tokyo (JP)

(72) Inventors: Takayuki Sekiguchi, Tokyo (JP); Tsuyoshi Ogino, Tokyo (JP)

(73) Assignee: TAIYO YUDEN CO., LTD., Tokyo (JP)

( * ) Notice: Subject to any disclaimer, the term of this patent is extended or adjusted under 35 U.S.C. 154(b) by 81 days.

(21) Appl. No.: 15/466,256

(22) Filed: Mar. 22, 2017

(65) Prior Publication Data

US 2017/0345558 A1 Nov. 30, 2017

(30) Foreign Application Priority Data

May 31, 2016 (JP) ..... JP2016-108346
Dec. 28, 2016 (JP) ..... JP2016-254735

(51) Int. Cl.
*H01F 27/29* (2006.01)
*H01F 27/32* (2006.01)

(52) U.S. Cl.
CPC ..... *H01F 27/324* (2013.01); *H01F 27/29* (2013.01)

(58) Field of Classification Search
CPC ..... H01F 27/324; H01F 27/29
USPC ..... 336/200, 232
See application file for complete search history.

(56) References Cited

U.S. PATENT DOCUMENTS

2003/0231093 A1* 12/2003 Hsu ..... H01L 27/08 336/200
2006/0006972 A1 1/2006 Tozawa et al.
2009/0139759 A1 6/2009 Ueda et al.
2010/0253464 A1 10/2010 Miyoshi et al.
2014/0078643 A1 3/2014 Odahara
(Continued)

FOREIGN PATENT DOCUMENTS

JP 11-273950 A 10/1999
JP 11273950 A * 10/1999
(Continued)

OTHER PUBLICATIONS

Office Action issued in corresponding Korean Patent Application No. 10-2017-0028851 dated Mar. 21, 2018 with English translation.
(Continued)

*Primary Examiner* — Tszfung J Chan
(74) *Attorney, Agent, or Firm* — Pillsbury Winthrop Shaw Pittman, LLP

(57) ABSTRACT

One object of the present invention is to provide a compact coil component with superior characteristics. An electronic component according one embodiment includes an insulator and a coil portion. The insulator is formed of a non-magnetic material. The insulator includes a width direction in a first axial direction, a length direction in a second axial direction, and a height direction in a third axial direction. The coil portion includes a circumference section. The circumference section is wound around the first axial direction. The coil portion is arranged inside the insulator. The first ratio of a height to a length of the insulator is 1.5 times or less of a second ratio of a height between first inner peripheral portions of the circumference section along the third axial direction with respect to a length between second inner peripheral portions of the circumference section along the second axial direction.

10 Claims, 29 Drawing Sheets

(56) References Cited

U.S. PATENT DOCUMENTS

| | | | | |
|---|---|---|---|---|
| 2015/0028988 | A1* | 1/2015 | Yamauchi | H01F 17/0013 336/200 |
| 2015/0137929 | A1* | 5/2015 | Park | H01F 17/0013 336/200 |
| 2016/0042862 | A1* | 2/2016 | Tachibana | H01F 27/2804 336/200 |

FOREIGN PATENT DOCUMENTS

| | | | | | |
|---|---|---|---|---|---|
| JP | 2002043129 | A | * | 2/2002 | |
| JP | 2004-207608 | A | | 7/2004 | |
| JP | 2004207608 | A | * | 7/2004 | |
| JP | 2006-032430 | | | 2/2006 | |
| JP | 2006-054207 | A | | 2/2006 | |
| JP | 2006-324489 | | | 11/2006 | |
| JP | 2010056177 | A | * | 3/2010 | |
| JP | 2011-049492 | A | | 3/2011 | |
| JP | 2012-079870 | A | | 4/2012 | |
| JP | 2014-232815 | | | 12/2014 | |
| JP | 2014232815 | A | * | 12/2014 | |
| JP | 2015-039026 | A | | 2/2015 | |
| JP | 2015039026 | A | * | 2/2015 | H01F 17/0013 |
| KR | 10-2006-0104996 | A | | 10/2006 | |
| KR | 10-2010-0110261 | A | | 10/2010 | |
| WO | 2014/181755 | A1 | | 11/2014 | |
| WO | WO-2014181755 | A1 | * | 11/2014 | H01F 17/0013 |

OTHER PUBLICATIONS

Notification of Reasons for Refusal dated Dec. 18, 2018 issued in corresponding Japanese Patent Application No. 2016-254735 with English translation.

Non-final Office Action dated Feb. 14, 2019 issued in corresponding Taiwanese Patent Application No. 106110097 with English translation.

Decision of Refusal dated Mar. 15, 2019 issued in corresponding Japanese Patent Application No. 2016-254735 with English translation.

Final Office Action dated Jul. 8, 2019 issued in corresponding Taiwanese Patent Application No. 106110097 with English translation.

Notice of Reasons for Refusal dated Apr. 28, 2020 issued in corresponding Japanese Patent Application No. 2016-254735 with English translation (10 pages).

* cited by examiner

COIL COMPONENT

CROSS-REFERENCE TO RELATED APPLICATIONS

This application is based on and claims the benefit of priority from Japanese Patent Application Serial Nos. 2016-254735 (filed on Dec. 28, 2016) and 2016-108346 (filed on May 31, 2016), the contents of which are hereby incorporated by reference in their entirety.

TECHNICAL FIELD

The present disclosure relates to a coil component including an insulator and a coil portion provided inside the insulator.

BACKGROUND

Many electronic apparatuses include coil components. Especially for mobile devices, coil components may have a chip form and may be surface-mounted on a circuit substrate included in the mobile devices. As an example of the prior art, Japanese Patent Application Publication No. 2006-324489 discloses a chip coil including a helical conductor that is embedded in a hardened insulating resin and at least whose one end is coupled to an external electrode. The helical direction of the conductor is arranged in parallel with the surface of a substrate on which the coil is mounted. Similarly, Japanese Patent Application Publication No. 2006-032430 discloses a laminated coil component having a coiled conductor formed such that its axial core direction is oriented in parallel with the surface of a substrate.

As another example, Japanese Patent Application Publication No. 2014-232815 disclosed a coil component including a resin insulator, a coil-shaped inner conductor provided inside the insulator, and an external electrode electrically coupled to the internal conductor. The insulator is made in a cuboid shape with the length L, the width W, and the height H, where $L>W\geq H$. The external electrode includes a conductor provided at each end of a plane perpendicular to the height H direction of the insulator as viewed in the length L direction. The internal conductor has a coil axis that is parallel with the width W direction of the insulator.

SUMMARY

As electronic devices are downsized and become thinner, electronic components mounted on such electronic substrates are also required to have a smaller size and thickness. However, such downsizing causes a significant degradation in characteristics of such electronic components. Thus, there is a demand for a compact coil component satisfying required characteristics.

In view of the above, one object of the disclosure is to provide a compact coil component with superior characteristics.

An electronic component according one embodiment of the disclosure may include an insulator and a coil portion. The insulator may be formed of a non-magnetic material. The insulator may have a width direction in a first axial direction, a length direction in a second axial direction, and a height direction in a third axial direction. The coil portion may include a circumference section. The circumference section may be wound around the first axial direction. The coil portion may be arranged inside the insulator. The first ratio of a height to a length of the insulator may be 1.5 times or less of a second ratio of a height between first inner peripheral portions of the circumference section along the third axial direction with respect to a length between second inner peripheral portions of the circumference section along the second axial direction.

The second ratio may be 0.6 to 1.0.

The third ratio of a first area partitioned by the first and second inner peripheral portions of the circumferential section with respect to a second area of the insulator portion as viewed from the first axis direction is typically 0.22 to 0.45.

The insulator is formed of typically a ceramic material or resin material

The third ratio of a first area partitioned by the first and second inner peripheral portions of the circumferential section with respect to a second area of the insulator portion as viewed from the first axis direction may be 0.22 to 0.45.

The insulator may be formed of a ceramic material or resin material

The insulator may formed into a cuboid shape; In this case, the coil component may further comprise a plurality of external electrodes electrically connected to the coil portion. Each of the plurality of external electrodes may be provided only on one surface of the insulator.

The coil portion and each of the plurality of external electrodes may be electrically connected through a connecting via conductive member, the connecting via conductive member is being connected to one end of the coil portion.

The cross section of the connecting via conductive member orthogonal to the third axial direction may be larger than a cross section of said one end of the coil portion orthogonal to the third axial direction.

The plurality of external electrodes may include an inner surface facing said one particular surface of the insulator and a plurality of projections. The projections may be formed on the inner surface and penetrate said one particular surface.

According to one aspect of the present disclosure, a downsized coil component with superior characteristics can be obtained.

DESCRIPTION OF EXAMPLE EMBODIMENTS

Embodiments of the disclosure will be described hereinafter with reference to the drawings.

First Embodiment—Basic Structure

Figure 1:
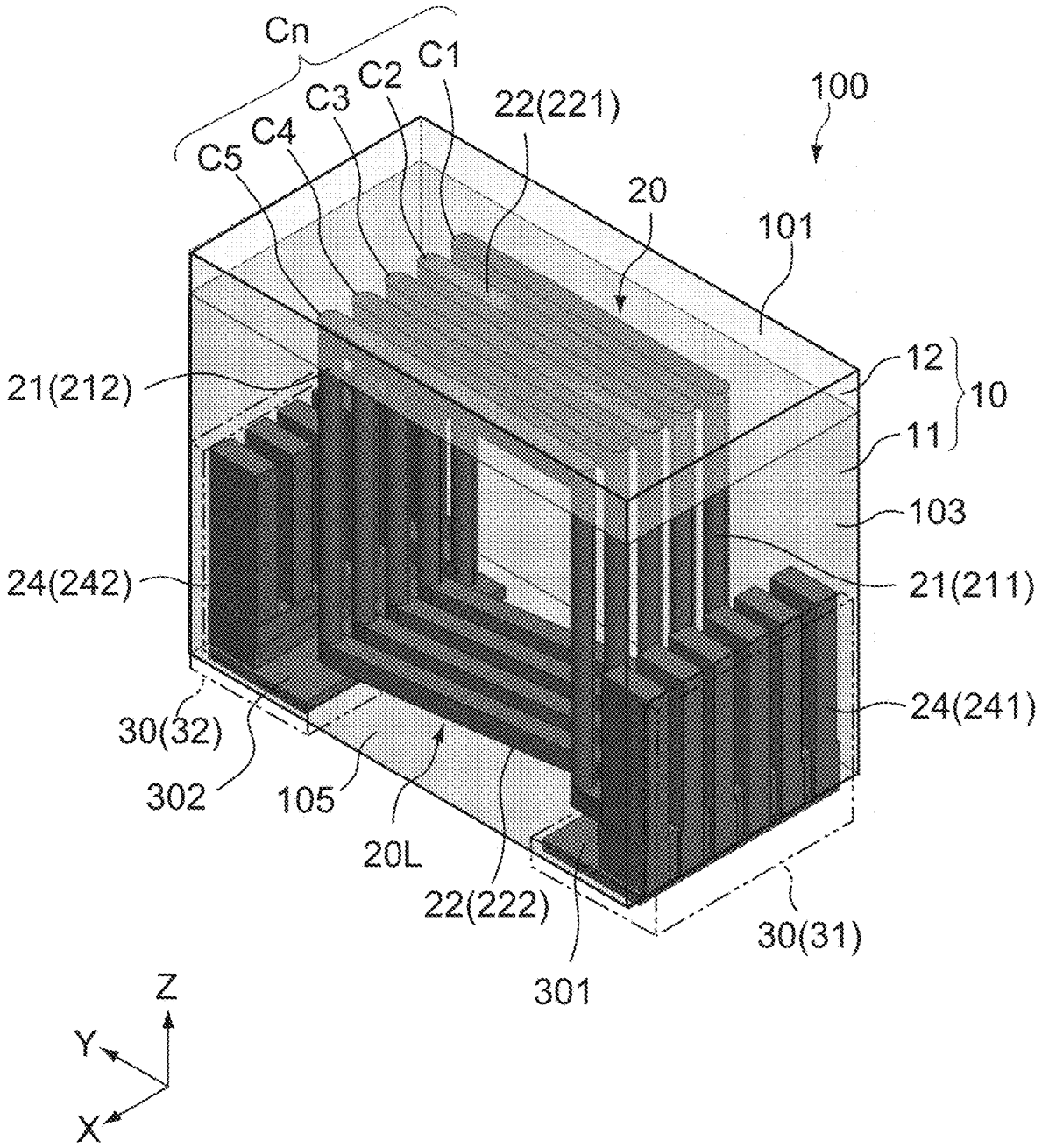
FIG. 1 is a schematic perspective view of an electronic component according to an embodiment of the disclosure.
Figure 2:
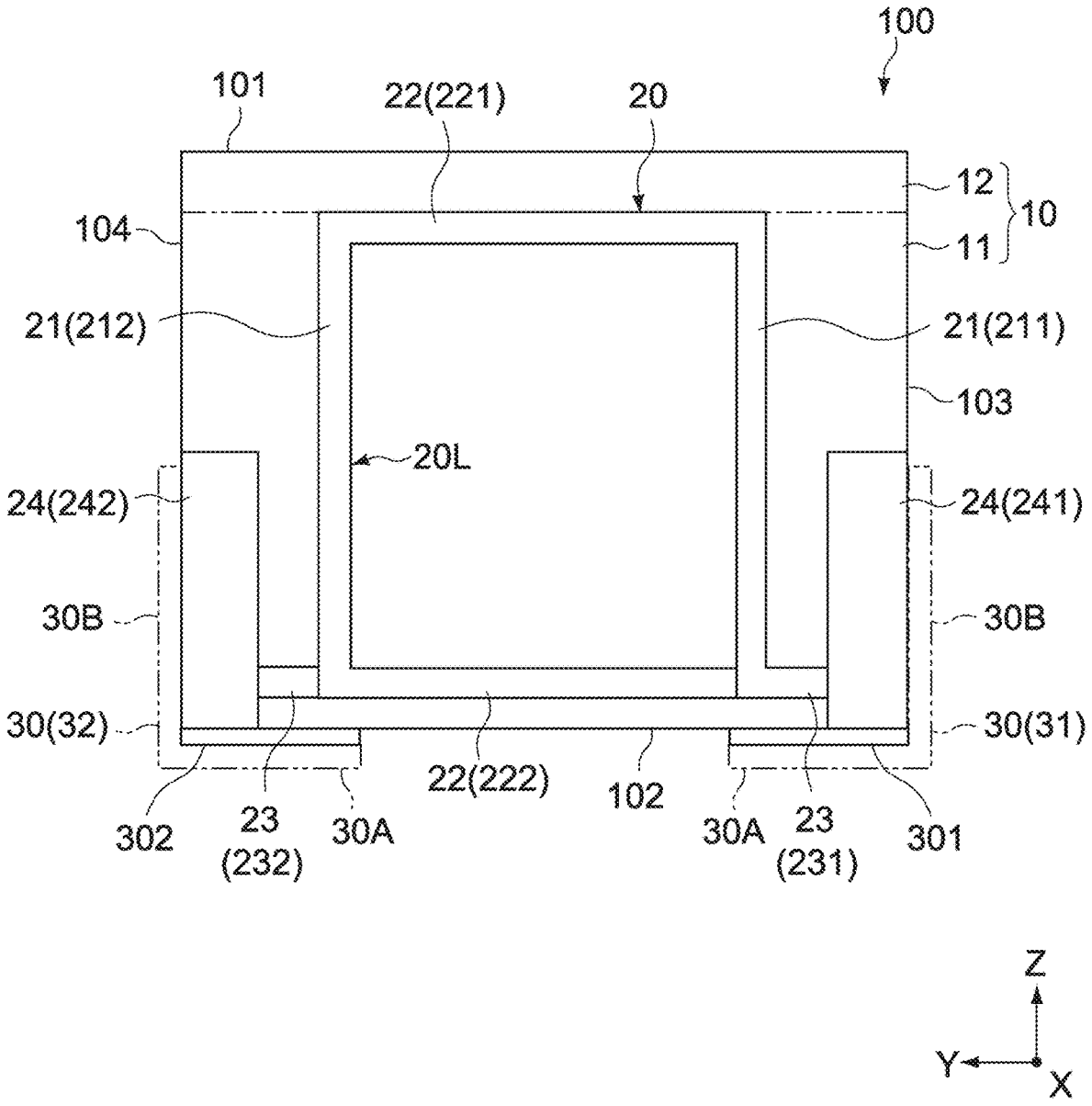
FIG. 2 is a schematic side view of the electronic component.
Figure 3:
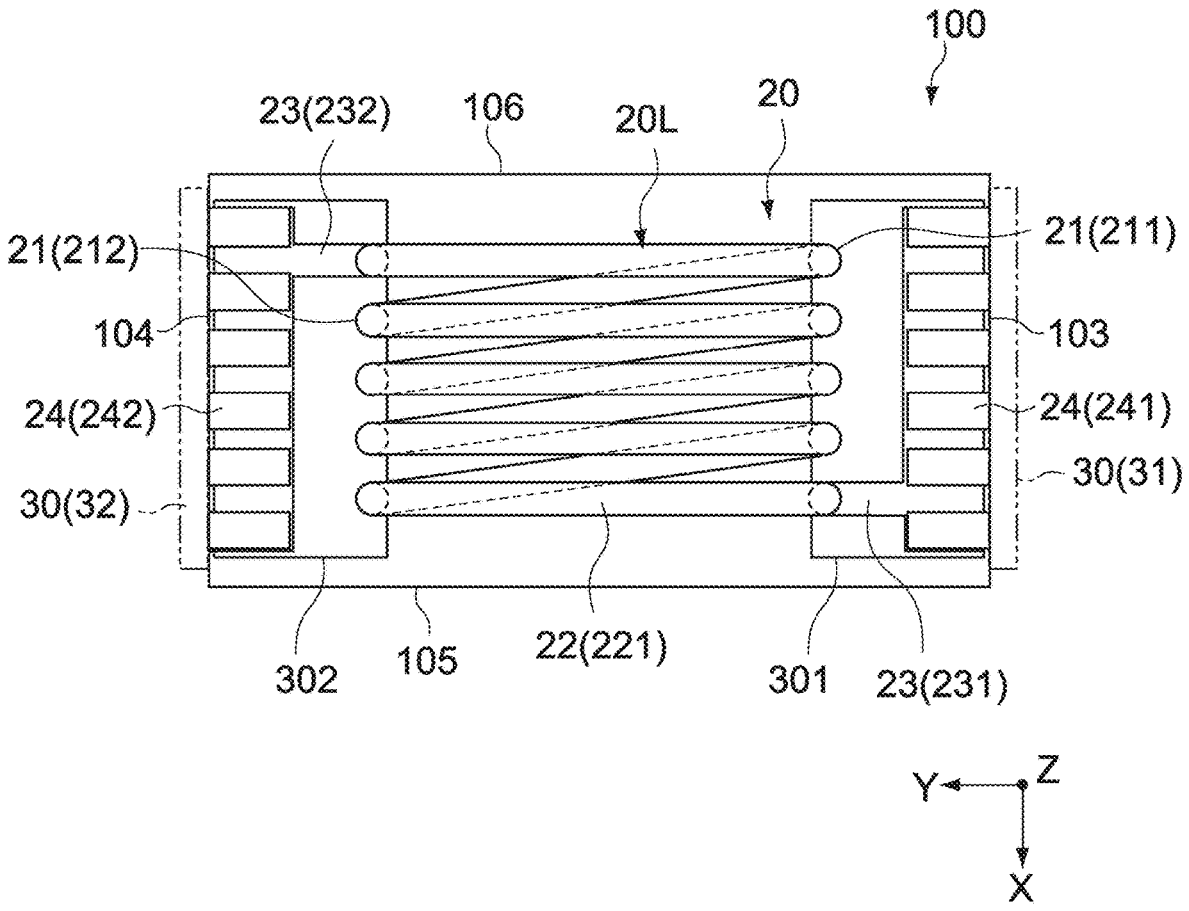
FIG. 3 is a schematic top view of the electronic component.

FIG. 1 is a schematic perspective view of an electronic component according to an embodiment of the disclosure, FIG. 2 is a schematic side view of the electronic component, and FIG. 3 is a schematic top view of the electronic component. In these drawings, the X-axis, Y-axis and Z-axis indicate three axial directions that are perpendicular to each other.

An electronic component 100 according to the embodiment may be configured as a coil component that is surface-mounted on a substrate. The electronic component 100 may include an insulator 10, an internal conductor 20, and an external electrode 30.

The insulator 10 may include a top surface 101, a bottom surface 102, a first end surface 103, a second end surface 104, a first side surface 105, and a second side surface 106. The insulator 10 is made in a cuboid shape that has the width in the X-axial direction, the length in the Y-axial direction and the height in the Z-axial direction. The insulator 10 may have a width of 0.05 to 0.2 mm, a length of 0.1 to 0.4 mm, and a height of 0.05 to 0.4 mm. In this embodiment, the width of the insulator 10 may be about 0.2 mm, the length may be about 0.35 mm, and the height may be about 0.2 mm.

The insulator 10 may include a body 11 and an upper portion 12. The body 11 may include the internal conductor 20 thereinside and form a main part of the insulator 10. The upper portion 12 provides the top surface 101 of the insulator 10. The upper portion 12 may be formed as, for example, a printed layer on which a model number of the electronic component 100 is printed.

The body 11 and the upper portion 12 may be formed of an insulating material. The insulating material mainly contains resin. The insulating material for the body 11 may be a resin that is cured by heat, light, a chemical reaction or the like. Such resins may include, for example, polyimide, epoxy resin, liquid crystal polymer, and the like. The upper portion 12 may be formed of the above-mentioned material, or a resin film or the like. Alternatively, the insulator 10 may be formed of ceramic materials such as glass.

The insulator 10 may be formed of a composite material that includes a filler in a resin. As such a filler, ceramic particles such as silica, alumina, zirconia or the like may be typically used. The configuration of the ceramic particles may be, but not limited to, spherical. Alternatively it may be an acicular shape, a scale-like shape or the like.

The internal conductor 20 may be provided inside the insulator 10. The internal conductor 20 may include a plurality of pillared conductive members 21 and a plurality of connecting conductive members 22. The plurality of pillared conductive members 21 and the plurality of connecting conductive members 22 together form a coil portion 20L.

The plurality of pillared conductive members 21 may be each formed in a substantially columnar shape with a central axis arranged in parallel with the Z-axial direction. The plurality of pillared conductive members 21 may include two groups of the conductors that are arranged so as to face to each other in the substantially Y-axial direction. One of the two conductor groups is first pillared conductive members 211. The first pillared conductive members 211 are arranged in the X-axial direction at a predetermined interval The other of the two conductor groups is second pillared conductive members 212. The second pillared conductive members 212 are also arranged in the X-axial direction at a predetermined interval.

The substantially columnar shape herein may include any columnar shape of which cross section perpendicular to the axis (in the direction perpendicular to the central axis) is a circle, an ellipse, or an oval. For example, the substantially columnar shape may mean any prism whose cross section is an ellipse or an oval in which the ratio of the major axis to the minor axis is 3 or smaller.

The first pillared conductive members 211 and the second pillared conductive members 212 may be configured to have the same radius and the same height respectively. The illustrated example includes five of the first pillared conductive members 211 and five of the second pillared conductive members 212. As will be further described later, the first and second pillared conductive members 211, 212 may be formed by stacking two or more via conductive members in the Z-axial direction.

Note that the reason why the pillared members have the substantially same radius is to prevent increase of resistance and this may be realized by reducing variation in the dimension of the pillared members as viewed in the same direction to 10% or smaller. Moreover the reason why the pillared members have the substantially same height is to secure stacking accuracy of the layers and this may be realized by reducing a difference in the height of the pillared members to, for example, 1 μm or smaller.

The plurality of connecting conductive members 22 may include two groups of conductors that are formed in parallel with the XY plane and arranged so as to face to each other in the Z-axial direction. One of the two conductor group is first connecting conductive members 221 that extend along the Y-axial direction and are arranged in the X-axial direction at a predetermined interval so as to connect between the first pillared conductive members 211 and the second pillared conductive members 212 respectively. The other of the two conductor group is second connecting conductive members 222 that extend at a predetermined angle with the Y-axial direction and are arranged in the X-axial direction at a predetermined interval so as to connect between the first pillared conductive members 211 and the second pillared conductive members 212 respectively. The illustrated example includes five of the first connecting conductive members 221 and five of the second connecting conductive members 222.

Referring aging to FIG. 1, the first connecting conductive members 221 are each connected with upper ends of a predetermined pair of the pillared conductive members 211, 212, and the second connecting conductive members 222 are each connected with lower ends of a predetermined pair of the pillared conductive members 211, 212. More specifically, the first and second pillared conductive members 211, 212 and the first and second connecting conductive members 221, 222 may be each connected to each other so as to form circumference sections Cn (C1-C5) of the coil portion 20L and such that the circumference sections Cn form a rectangular helix in the X-axial direction. In this manner, provided is the coil portion 20L that has the central axis (a coil axis) in the X-axial direction and has an rectangular opening.

In this embodiment, the circumference sections Cn include five circumference sections C1-C5. The opening of each of the circumference sections C1-C5 may have a substantially same shape.

The internal conductor 20 may further include an extended portion 23, a comb-tooth block portion 24 and the coil portion 20L may be connected to the external electrode 30 (31, 32).

The extended portion 23 may include a first extended portion 231 and a second extended portion 232. The first extended portion 231 may be coupled to a lower end of the first pillared conductive member 211 that forms one end of the coil portion 20L, and the second extended portion 232 may be coupled to a lower end of the second pillared conductive member 212 that forms the other end of the coil portion 20L. The first and second extended portions 231, 232 may be provided in the XY plane in which the second connecting conductive members 222 are provided and may be arranged in parallel with the Y-axial direction.

The comb-tooth block portion 24 may include a first comb-tooth block 241 and a second comb-tooth block 242. The first comb-tooth block 241 and the second comb-tooth block 242 are disposed so as to face to each other in the Y-axial direction. The first and second comb-tooth blocks 241, 242 may each be arranged such that their comb tooth ends face upward in FIG. 1. A part of the first and second comb-tooth blocks 241, 242 may be exposed on the end surfaces 103, 104 and the bottom surface 102 of the insulator 10. The first and second extended portions 231, 232 may be coupled to a space between predetermined two adjacent comb teeth of the first and second comb-tooth block portions 241, 242 respectively (see FIG. 3). At the bottom of the first and second comb-tooth block portions 241, 242, conductive layers 301, 302 that are underlayers of the external electrode 30 may be provided respectively (see FIG. 2).

The external electrode 30 may form an external terminal for surface mounting. The external electrode 30 may include first and second external electrodes 31, 32 that face to each other in the Y-axial direction. The first and second external electrodes 31, 32 may be formed in designated regions on the outer surface of the insulator 10.

More specifically, the first and second external electrodes 31, 32 may each include a first portion 30 A that covers each end of the bottom surface of the insulator 10 in the Y-axial direction, and a second portion 30B that covers the end surfaces 103, 104 of the insulator 10 over a predetermined height of the end surfaces 103, 104 as illustrated in FIG. 2. The first portions 30 A may be electrically connected to the bottoms of the first and second comb-tooth block portions 241, 242 through the conductive layers 301, 302 respectively. The second portion 30B may be formed on the end surfaces 103, 104 of the insulator 10 so as to cover the comb teeth portions of the first and second comb-tooth block portions 241, 242.

The pillared conductive members 21, the connecting conductive members 22, the extended portion 23, the comb-tooth block portion 24, and the conductive layers 301, 302 may be formed of a metal such as Cu (copper), Al (aluminum), Ni (nickel) or the like. In this embodiment, these may be formed of copper or a copper alloy plated layer. The first and second external electrodes 31, 32 may be formed by, for example, Ni/Sn plating.

Figure 4:
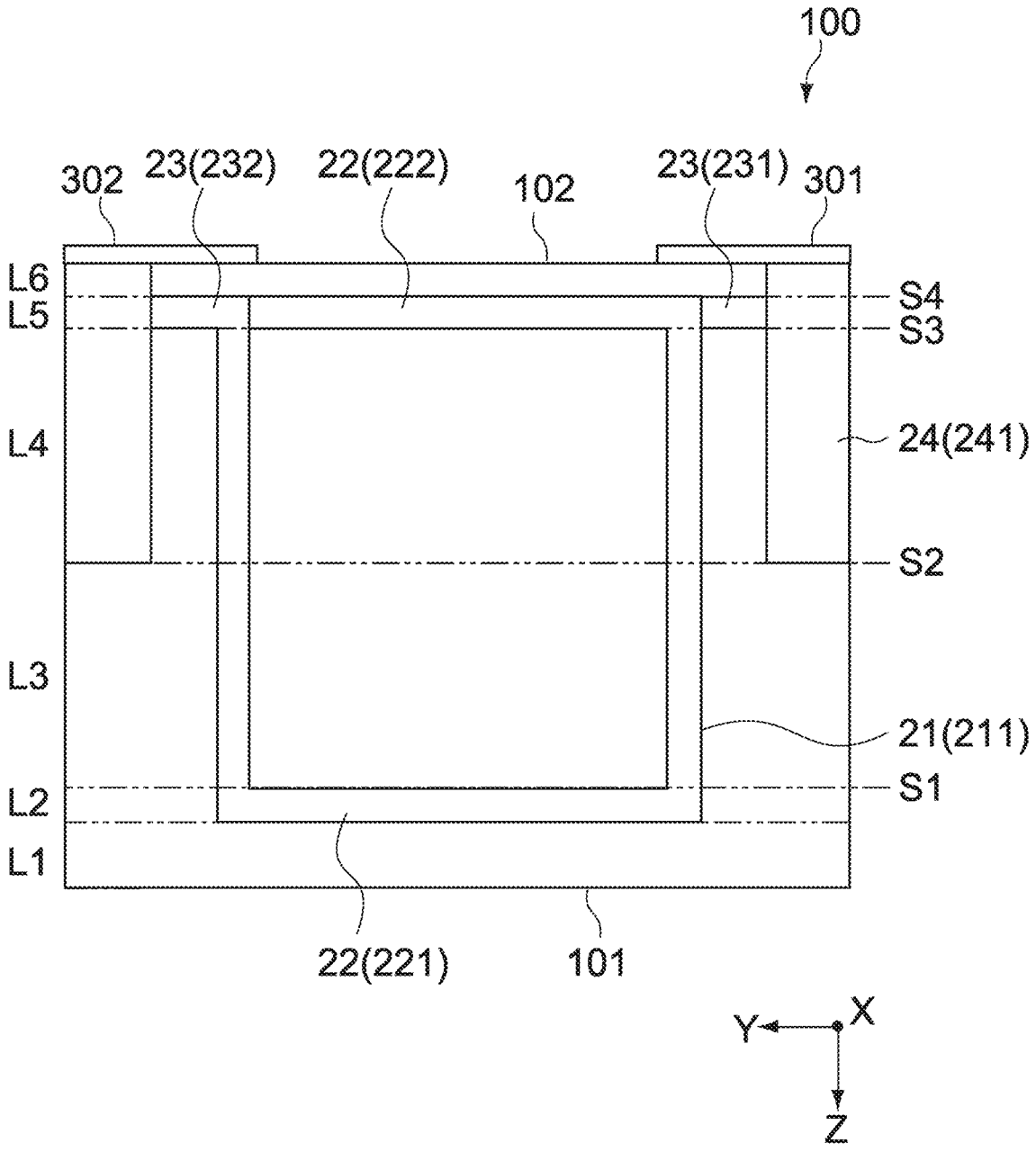
FIG. 4 is a schematic perspective side view of the upside-down electronic component.

FIG. 4 is a schematic side view of the upside-down electronic component 100. As shown in FIG. 4, the electronic component 100 may include a film layer L1 and electrode layers L2-L6. In the embodiment, the film layer L1 and the electrode layers L2-L6 may be stacked sequentially in the Z-axial direction from the top surface 101 to the bottom surface 102. The number of the layers may not be particularly limited and may be six in this example.

The film layer L1 and the electrode layers L2-L6 may include corresponding insulator 10 and internal conductor 20. FIGS. 5A-5F are schematic top views of the film layer L1 and the electrode layers L2-L6 of FIG. 4.

Figure 5A:
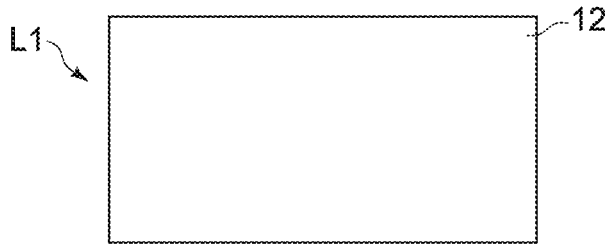
FIGS. 5A to 5F illustrate schematic top views of electrode layers included in the electronic component.
Figure 5B:
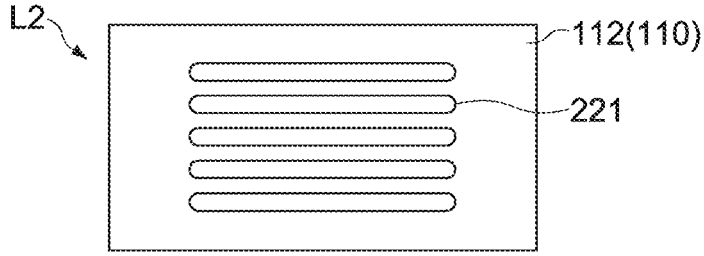
Figure 5C:
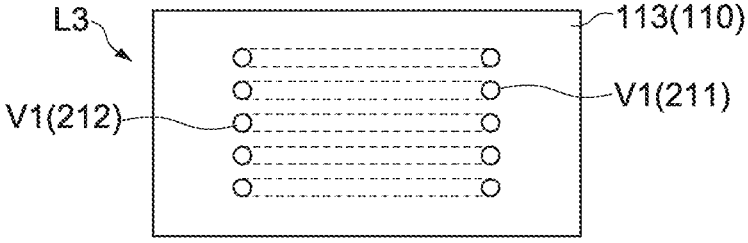
Figure 5D:
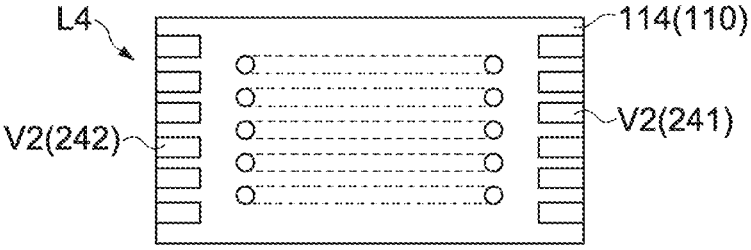

The film layer L1 may be formed of the upper portion 12 that serves as the top surface 101 of the insulator 10 (FIG. 5A). The electrode layer L2 may include an insulating layer 110 (112) and the first pillared conductive members 211 (FIG. 5B). The insulating layer 110 (112) forms a part of the insulator 10 (the body 11). The electrode layer L3 may include the insulating layer 110 (113), and via conductive members V1 that form a part of the pillared conductive members 211, 212 (FIG. 5C). The electrode layer L4 may include the insulating layer 110 (114), the via conductive members V1, and via conductive members V2 that form a part of the comb-tooth block portions 241, 242 (FIG. 5D).

Figure 5E:
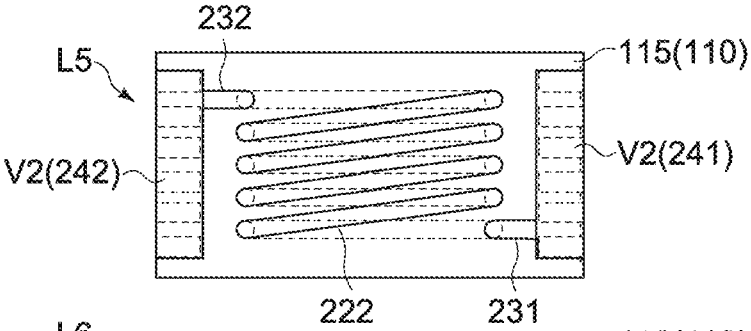
Figure 5F:
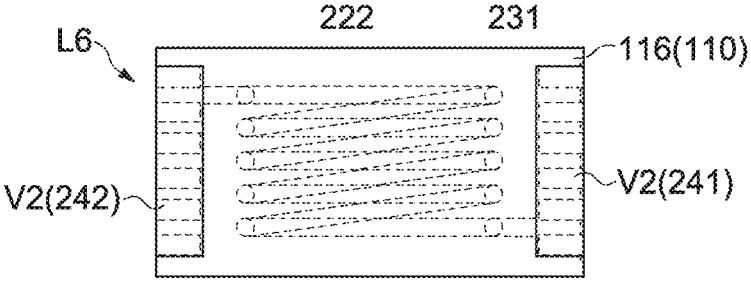

The electrode layer L5 may include the insulating layer 110 (115), the via conductive members V1, V2, the extended portions 231, 232, and the second connecting conductive members 222 (FIG. 5E). The electrode layer L6 may include the insulating layer 110 (116) and the via conductive members V2 (FIG. 5F).

The electrode layers L2-L6 may be stacked in the height direction with bonding surfaces S1-S4 (see FIG. 4) interposed therebetween. Accordingly, the insulating layers 110 and the via conductive members V1, V2 have boundaries in the height direction. The electronic component 100 may be manufactured by a build-up method in which the electrode layers L2-L6 are sequentially fabricated and layered in the stated order from the electrode layer L2.

Basic Manufacturing Process

A basic manufacturing process of the electronic component 100 will be now described. A plurality of the electronic components 100 may be simultaneously fabricated on a wafer and may be then diced into pieces (chips).

FIGS. 6 to 8 are schematic sectional views of an element unit area to illustrate a part of the manufacturing process of the electronic component 100. More specifically, in the manufacturing process, a resin film 12A (the film layer L1) is adhered to a base plate S to form the upper portion 12 and the electrode layers L2 to L6 are sequentially formed thereon. As the base plate S, a silicon, glass or sapphire substrate may be used. Typically a conductive pattern that forms the internal conductor 20 may be formed by electroplating, subsequently the formed conductive pattern may be covered by an insulating resin material to form the insulating layer 110. These steps may be repeated.

FIGS. 6A to 6E and FIGS. 7A to 7D illustrate a manufacturing process of the electrode layer L3.

Figure 6A:
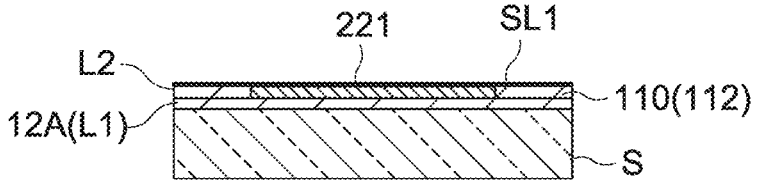
FIGS. 6A to 6E are schematic sectional views of an element unit area to illustrate a basic manufacturing flow of the electronic component.

In this process, a seed layer (a feed layer) SL1 for electroplating may be formed on the surface of the electrode layer L2 by, for example, sputtering (FIG. 6A). The seed layer SL1 may be formed of any conductive material, for example, Ti (titanium) or Cr (chromium). The electrode layer L2 may include the insulating layer 112 and the connecting conductive members 221. The connecting conductive members 221 may be provided under the insulating layer 112 so as to contact the resin film 12A.

Figure 6B:
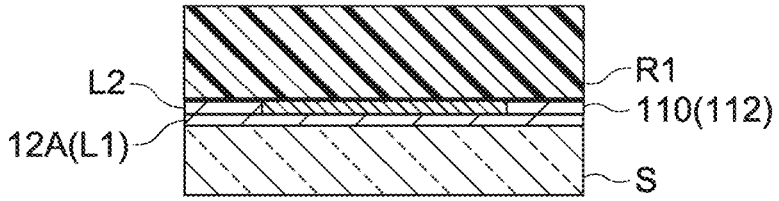
Figure 6C:
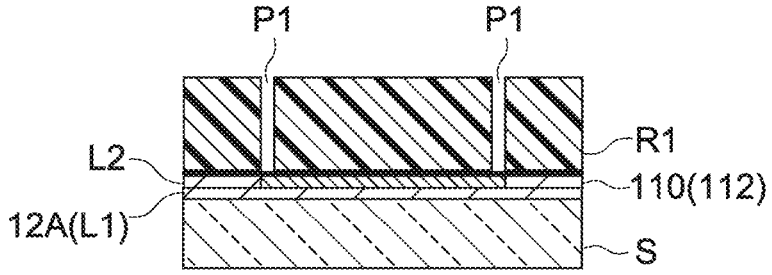
Figure 6D:
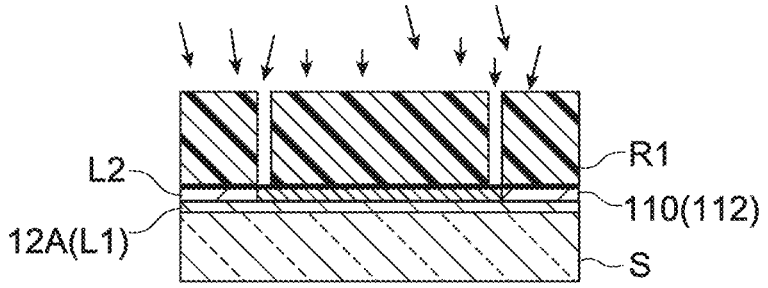

Subsequently a resist film R1 may be formed on the seed layer SL1 (FIG. 6B). The resist film R1 may be exposed and developed to form a resist pattern having a plurality of openings P1 that correspond to the via conductive members V13 which form a part of the pillared conductive members 21 (211, 212) through the seed layer SL1 (FIG. 6C). Subsequently a descum process may be performed to remove resist residue in the opening P1 (FIG. 6D).

Figure 6E:
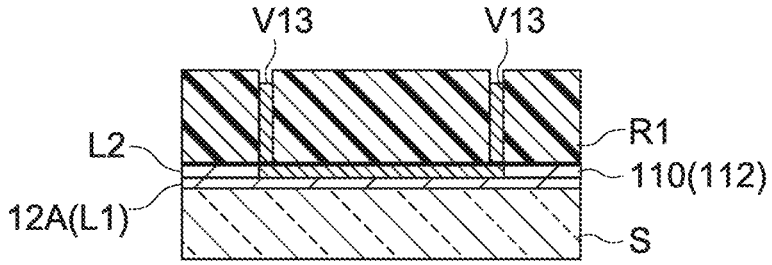
Figure 7A:
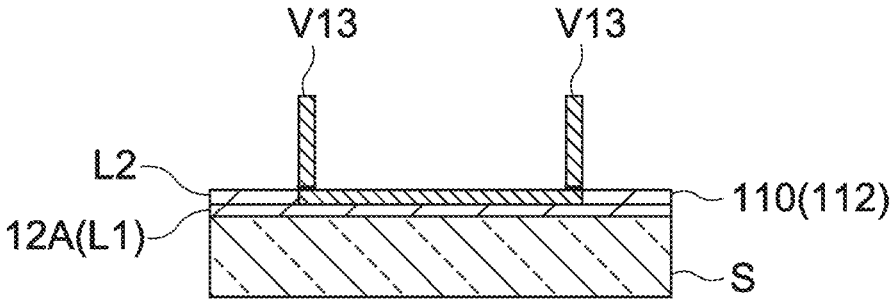
FIGS. 7A to 7D are schematic sectional views of an element unit area to illustrate a basic manufacturing flow of the electronic component.
Figure 7B:
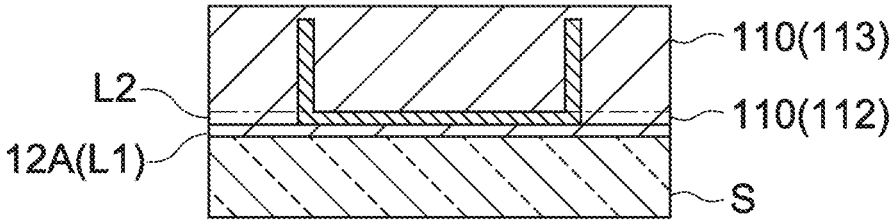
Figure 7C:
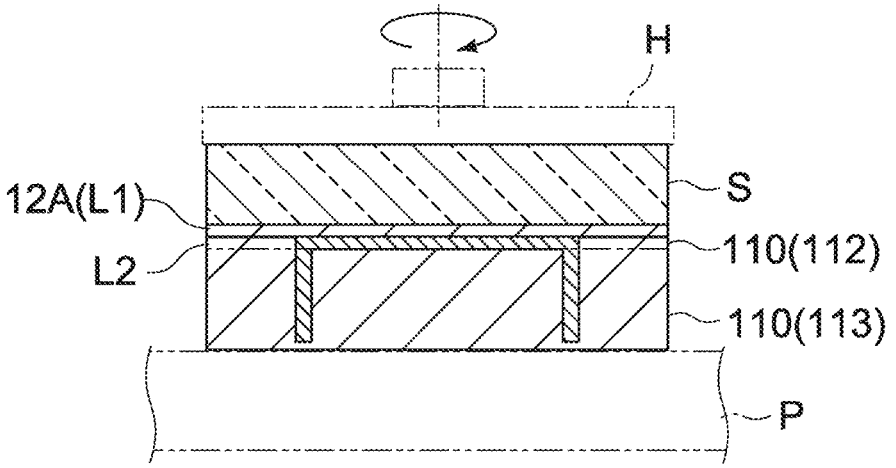
Figure 7D:
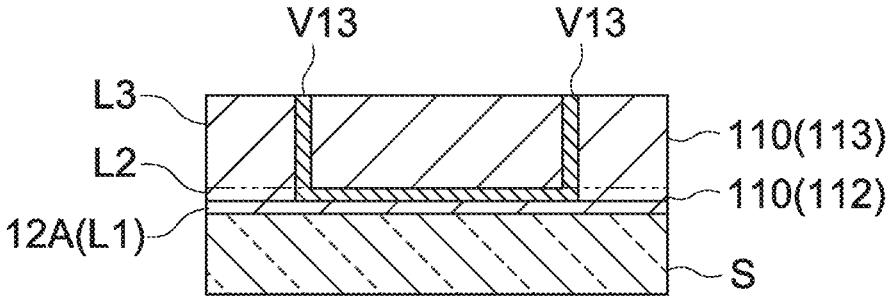

The base plate S may be then immersed in a Cu plating bath and an voltage may be applied to the seed layer SL1 to form the plurality of via conductive members V13 made of a Cu plating layer within the openings P1 (FIG. 6E). After the resist film R1 and the seed layer SL1 may be removed (FIG. 7A), the insulating layer 113 that covers the via conductive members V13 may be formed (FIG. 7B). The insulating layer 113 may be formed by printing or applying a resin material or applying a resin film on the electrode layer L2 and then hardening the resin. After the resin is hardened, the surface of the insulating layer 113 may be polished so as to expose tips of the via conductive members V13 by using a polishing apparatus such as a chemical mechanical polish machine (CMP machine), a grinder or the like (FIG. 7C). FIG. 7C illustrates an example of the polishing process (CMP) of the insulating layer 113 with a revolving polishing pad P. Here, the base plate S may be placed upside down on a polishing head H that is capable of spinning. As described above, the electrode layer L3 may be formed on the electrode layer L2 (FIG. 7D).

A fabrication method of the insulating layer 112 has not been described above, but it may be typically formed in the same manner as the insulating layer 113, more specifically, a resin material may be printed or applied or a resin film may be applied and then cured. The cured resin may be then polished by chemical mechanical polishing (CMP), a grinder or the like.

In the same manner as described above, the electrode layer L4 may be formed on the electrode layer L3.

A plurality of via conductive members (second via conductive members) that are coupled to the via conductive members V13 (first via conductive members) may be formed on the insulating layer 113 (a second insulating layer) of the electrode layer L3. More specifically, a seed layer that covers the surface of the first via conductive members may be formed on the surface of the second insulating layer. A resist pattern that has openings at the position corresponding to the surface of the first via conductive members may be then formed and the second via conductive members may be formed by electroplating using the resist pattern as a mask. A third insulating layer that covers the second via conductive members may be subsequently formed on the second insulating layer. The surface of the third insulating layer may be then polished to expose tips of the second via conductive members.

In the above-described fabrication process of the second via conductive members, the via conductive members V2 that form a part of the comb-tooth block portion 24 (241, 242) may be formed at the same time (see FIG. 4 and FIG. 5D). In this case, the resist pattern has openings that correspond to the region where the via conductive members V2 are formed in addition to the openings that correspond to the region where the second via conductive members are formed.

FIGS. 8A to 8D illustrate a part of the manufacturing process of the electrode layer L5.

Figure 8A:
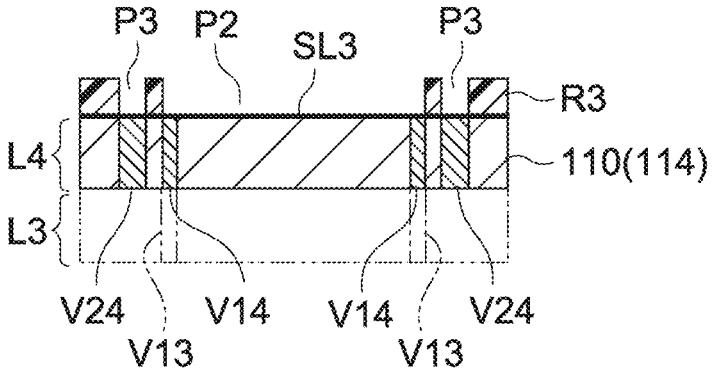
FIGS. 8A to 8D are schematic sectional views of an element unit area to illustrate a basic manufacturing flow of the electronic component.
Figure 8B:
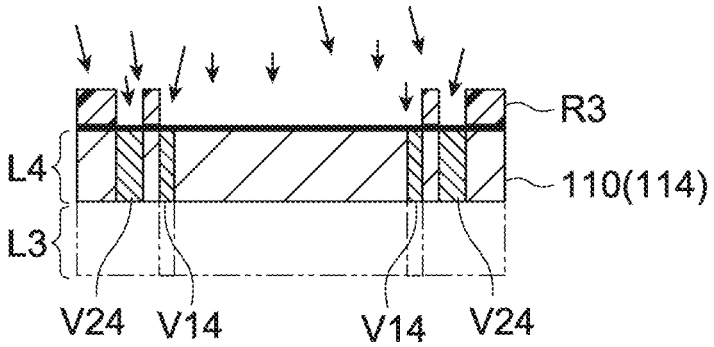

A seed layer SL3 for electroplating may be firstly formed on the electrode layer L4, and then a resist pattern (a resist film R3) that has openings P2, P3 may be sequentially formed on the seed layer SL3 (FIG. 8A). Subsequently a descum process may be performed to remove resist residue in the openings P2, P3 (FIG. 8B).

The electrode layer L4 may include the insulating layer 114 and via conductive members V14, V24. The via conductive members V14 may correspond to the via members (V1) that form a part of the pillared conductive members 21 (211, 212), and the via conductive members V24 may correspond to the via members (V2) that correspond to a part of the comb-tooth block portion 24 (241, 242) (see FIGS. 5C and 5D). The opening P2 may face the via conductive member V14 in the electrode layer L4 with the seed layer SL3 interposed therebetween, and opening P3 may face the via conductive member V24 in the electrode layer L4 with the seed layer SL3 interposed therebetween. The openings P2 may be each formed in the shape that conforms with the corresponding connecting conductive member 222.

Figure 8C:
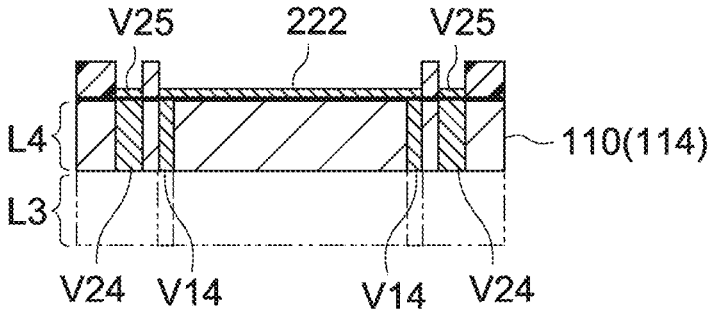

The base plate S may be then immersed in a Cu plating bath and an voltage may be applied to the seed layer SL3 to form via conductive members V25 and the connecting conductive members 222 made of a Cu plating layer within the openings P2, P3 (FIG. 8C). The via conductive members V25 may correspond to the via members (V2) that form a part of the comb-tooth block portion 24 (241, 242).

Figure 8D:
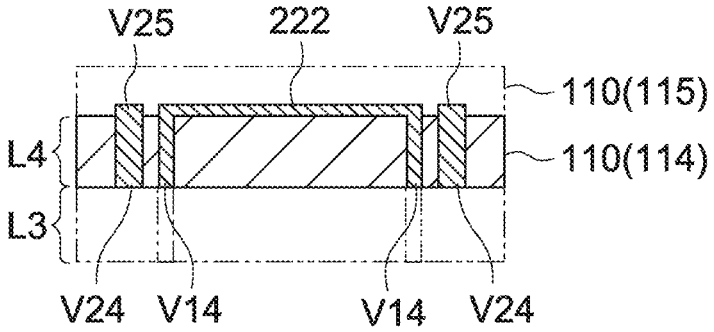

After the resist film R3 and the seed layer SL3 are removed, the insulating layer 115 that covers the via conductive members V25 and the connecting conductive members 222 may be formed (FIG. 8D). Although it is not illustrated in the drawings, the surface of the insulating layer 115 may be polished to expose tips of the via conductive members V25, the seed layer and the resist pattern may be subsequently formed, and the electroplating process may be then performed. By repeating the above-described processes, the electrode layer L5 illustrated in FIG. 4 and FIG. 5E is fabricated.

After the conductive layers 301, 302 are formed on the comb-tooth block portion 24 (241, 242) exposed on the surface (the bottom surface 102) of the insulating layer 115, the first and second external electrodes 31, 32 may be formed.

Structure In The Embodiment

As electronic devices are downsized in recent years, it tends to be difficult to secure coil characteristics. Characteristics of a coil component depend largely on the size, shape and the like of the coil portion included in a coil component, and a larger opening size typically leads to higher inductance characteristics. However, the downsizing of a coil component constrains the size of the insulator and the constrained insulator size results in deteriorated inductance characteristics. Therefore, this embodiment provides a compact coil component with superior characteristics by optimizing the dimensional ratio of the opening of the coil portion.

Figure 9A:
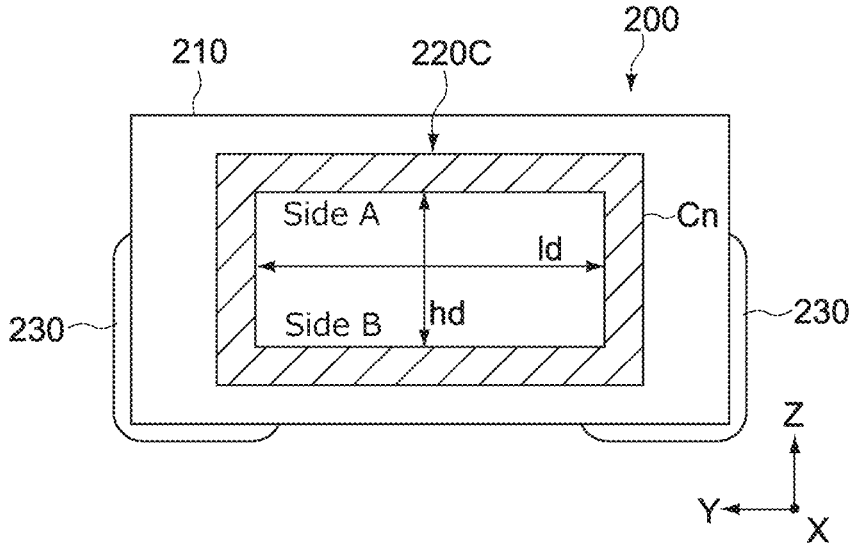
FIGS. 9A to 9C schematically show high frequency characteristics of a coil component.
Figure 9B:
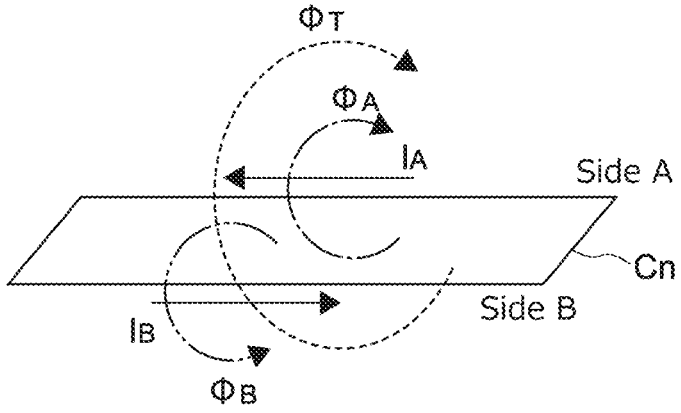
Figure 9C:
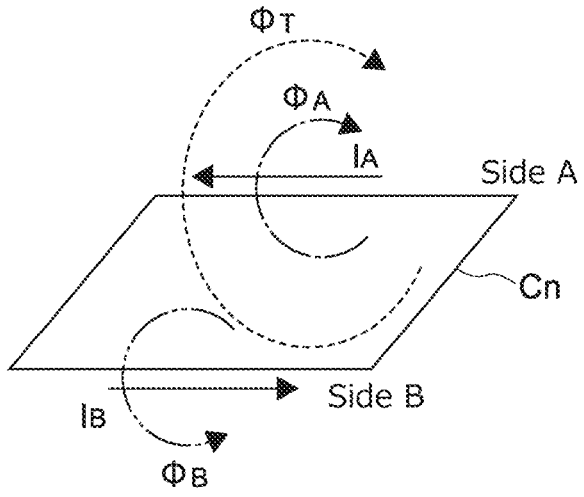

FIG. 9A-FIG. 9C are schematic views of a coil component for explaining high frequency characteristics of the coil component. The coil component 200 shown in FIG. 9A includes insulator 210 and coil portion 220C arranged in the insulator 210. The insulator may have a cuboid shape. For ease of understanding, the circumference section Cn is represented by the hatched ring having a simple rectangular shape (FIG. 10 uses a similar hatched ring to represent circumference section Cn). The reference number 230 denotes external electrode.

In a typical downsizing process, the insulator 210 is made low-profile by bringing into closer relationship the upper side (hereinafter, referred to as the "Side A") and the lower side (hereinafter, referred to as the "Side B") of the circumference section Cn. The Side A and the Side B with a closer distance therebetween increases mutual interference between the magnetic flux (magnetic field) generated by the Side A and the magnetic flux generated by the Side B. For example, as shown in FIG. 9B, when the magnetic flux φA is generated by electric current IA flowing through the Side A and the magnetic flux φB is generated by electric current IB flowing through the Side B, the direction of the magnetic flux φA is opposite to that of the magnetic flux φB. Accordingly, the closer the Side A and the Side B are to each other, the greater the mutual interference (cancellation) between the magnetic flux φA and the magnetic flux φB becomes. As a result, the superposed magnetic flux φT in the opening of the circumference section Cn becomes small, causing failure to generate an inductance as designed In this embodiment, by increasing the distance between the Side A and Side B, as shown in FIG. 9C, the mutual interference between the magnetic flux φA and the magnetic flux φB may be suppressed, the superposed magnetic flux φT for the circumference section Cn is increased, and thereby a higher inductance may be achieved. Such a higher inductance makes it possible to shorten the line length and as a result to decrease the resistance thereof, thereby attaining a higher Q value.

A required distance between the Side A and Side B of the circumference section Cn may be secured by increasing the hight of the insulator 210. In so doing, it is not necessary to increase the mounting area of the coil component. Accordingly, it is possible to provide a compact coil component with superior characteristics.

The coil component 200 manufactured by use of a typical downsizing method has a small dimensional ratio (Hd/ld) of the inner circumferential surface corresponding to the opening (core) of the circumferential section due to the dimensional constraints in the external dimension of the chip component (See, FIG. 9). On the other hand, in this embodiment, the external dimension of the chip component has been redesigned so as to heighten the dimensional ratio (Hd/ld) without changing the volume of the insulator 10. Thus, a higher inductance may be efficiently achieved, and thereby obtaining a coil component with a high Q value.

Figure 10:
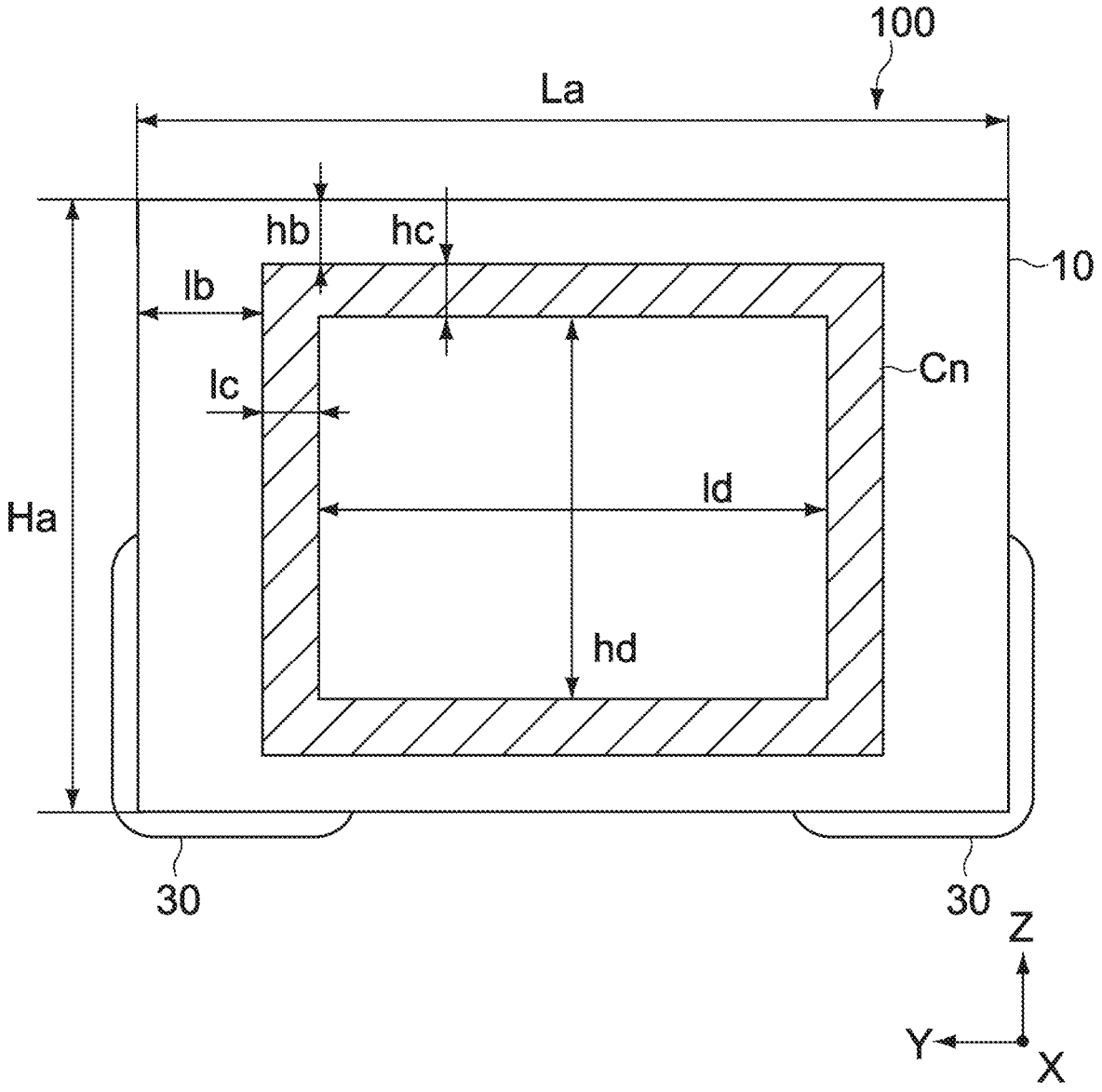
FIG. 10 illustrates a schematic side view of the electronic component with sizes of various elements of the electronic component.

More particularly, the coil component 100 in accordance with this embodiment, as shown in FIG. 10, may be configured such that the ratio (Ha/La) of the height (Ha) of the insulator part 10 to the length (La) of the insulator part 10 is 1.5 times or less of the ratio (Hd/ld) of the height (hd) between the inner peripheral portions of the circumference section Cn along the Z-axial direction with respect to the length (ld) between the inner peripheral portions of the circumference section Cn along the Y-axial direction. Thus, the Q value of the coil component 100 may be efficiently enhanced.

Here, "the length (ld) between the inner peripheral portions of the circumference section Cn along the Y-axial direction" refers to the distance along the Y-axial direction between the opposed surfaces of the first and second pillared conductive members 211, 212 projected to the YZ plane. Also, "the height (hd) between the inner peripheral portions of the circumference section Cn along the Z-axial direction" means the distance along the Z-axial direction between the opposed surfaces of the first and second connecting conductive members 221, 222 projected to the YZ plane. In measuring the length (ld) between the inner peripheral portions of the circumference section Cn, the coil component 100 is processed by cross section grinding or milling to a plane extending the center of the insulator in the Z-axial direction (the height direction). The length (ld) between the inner peripheral portions of the circumference section Cn may be obtained by measuring the distance between the first and second pillared conductive members 211, 212 by a scanning electron microscope (SEM) at a magnification of about 200×. In measuring the height (hd) between the inner peripheral portions of the circumference section Cn, the coil component 100 is processed by cross section grinding or milling to a plane extending the center of the insulator in the X-axial direction (the width direction). The height (hd) between the inner peripheral portions of the circumference section Cn may be obtained by measuring the distance between the first and second connecting conductive members 221, 222 by use of SEM. The above observation sample may be used when measuring the dimensions of other sections.

In this embodiment, the opening dimensional ratio (Hd/ld) of the circumference section Cn maybe, for example, 0.6 to 1.2. It should be noted that the opening dimensional ratio (Hd/ld) is not limited to the above range. Thus, it is possible to stably secure a high inductance value and Q value.

The ratio (Sd/Sa) of the area (Sd) partitioned by the inner circumferential portion of the circumferential section Cn with respect to the area (Sa) of the insulator portion 12 as viewed from the coil axial direction (X-axial direction) may be, for example, 0.22 to 0.45 (22% to 45%). It should be noted that the ratio (Sd/Sa) is not limited to the above range. Thus, the inductance value of the coil component 100 may be efficiently enhanced.

Furthermore, according to the embodiment, the first and second comb-tooth blocks 241, 242 may compensate for lack of stiffness of the insulator 10 due to its increased height as each of the first and second comb-tooth blocks 241, 242 is arranged such that their comb tooth ends face upward in FIG. 1. Thus, the reliability of the coil component 100 may be enhanced.

EXPERIMENT EXAMPLE

Figure 11:
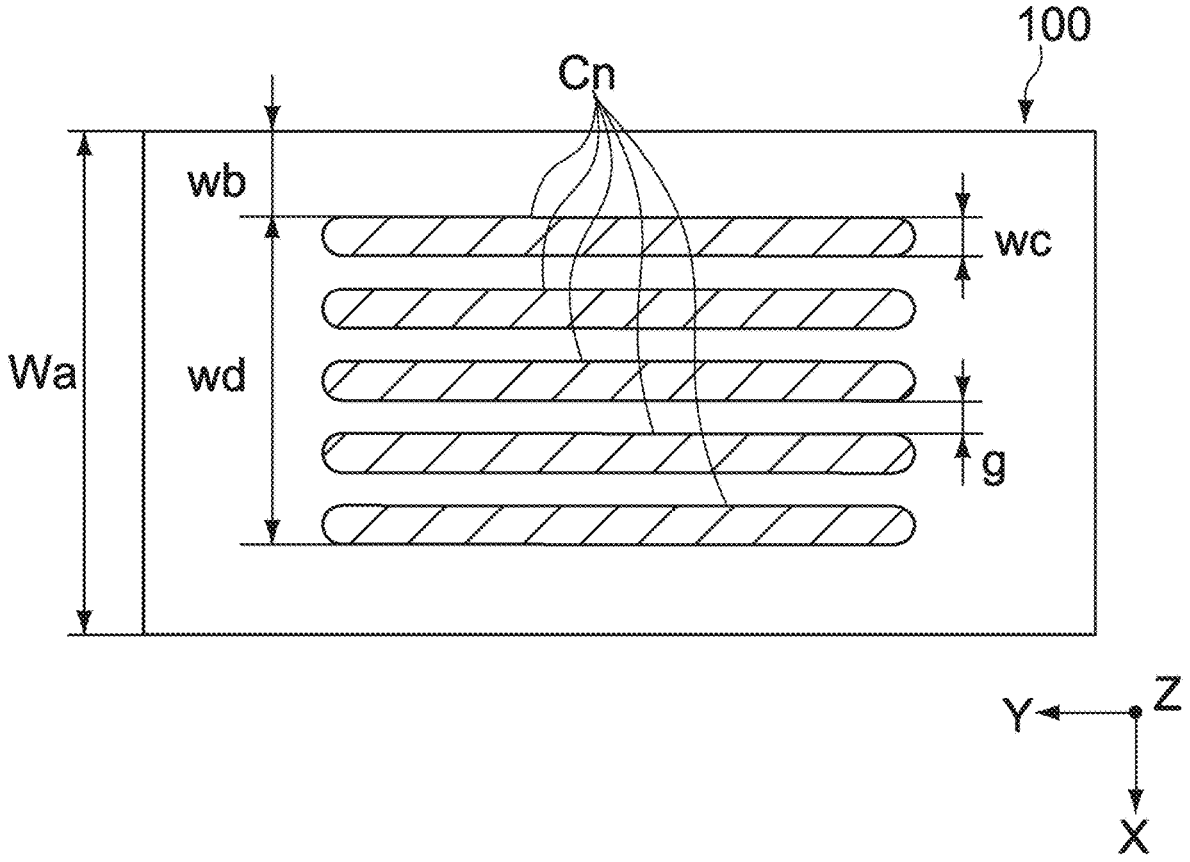
FIG. 11 illustrates a schematic top view of the electronic component with sizes of various elements of the electronic component.

With reference to FIGS. 10 and 11, experiments performed by the inventors will be described. The opening of the circumference section Cn may be referred to as a core portion.

Test Example 1

A sample of coil component was produced to include an insulator formed of glass and a coil portion. Their dimensions were as follows:

Insulator: a length (La) 370 μm; a width (Wa) 200 μm; and a height (Ha) 215 μm

Coil portion: a conductor dimension in the Y-axial direction (lc) 35 μm; a conductor dimension in the X-axial direction (wc) 10 μm; a conductor dimension in the Z-axial direction (hc) 35 μm; intervals between the adjacent portions of the circumference section in the X-axial direction (inter-conductor distance g) 20 μm; a core portion dimension in the Y-axial direction (ld) 200 μm; a core portion dimension in the circumference section Cn in the X-axial direction (wd) 130 μm; a core portion dimension in the Z-axial direction (hd) 85 μm Side margin: a Y-axis margin (lb) 50 μm; an X-axis margin (wb) 30 μm; a Z-axis margin (hb) 30 μm.

An RF impedance analyzer (E4991A from Agilent Technologies) was used to measure the inductance value (L value) and the Q value of the produced sample at 500 MHz and at 1.8 GHz, respectively. The measured L value was 2.6 nH and the measured Q value was 27.

Test Example 2

Another sample was produced under the same conditions as in Test Example 1 except that the length (La), width (Wa) and height (Ha) of the insulator were 350 μm, 200 μm, and 230 μm, respectively and the core portion dimension in the Y-axial direction (ld), that in the X-axial direction (wd), and that in the Z-axial direction (hd) were 180 μm, 130 μm, and 100 μm, respectively. The inductance (L value) and Q value of the produced sample were measured under the same conditions as in Test Example 1. The measured L value was 2.7 nH and the measured Q value was 28.

Test Example 3

Another sample was produced under the same conditions as in Test Example 1 except that the length (La), width (Wa) and height (Ha) of the insulator were 320 μm, 200 μm, and 250 μm, respectively and the core portion dimension in the Y-axial direction (ld), that in the X-axial direction (wd), and that in the Z-axial direction (hd) were 150 μm, 130 μm, and 120 μm, respectively. The inductance (L value) and Q value of the produced sample were measured under the same conditions as in Test Example 1. The measured L value was 2.8 nH and the measured Q value was 29.

Test Example 4

Another sample was produced under the same conditions as in Test Example 1 except that the length (La), width (Wa) and height (Ha) of the insulator were 305 μm, 200 μm, and 265 μm, respectively and the core portion dimension in the Y-axial direction (ld), that in the X-axial direction (wd), and that in the Z-axial direction (hd) were 135 μm, 130 μm, and 135 μm, respectively. The inductance (L value) and Q value of the produced sample were measured under the same conditions as in Test Example 1. The measured L value was 2.9 nH and the measured Q value was 30.

Test Example 5

Another sample was produced under the same conditions as in Test Example 1 except that the length (La), width (Wa) and height (Ha) of the insulator were 275 μm, 200 μm, and 290 μm, respectively and the core portion dimension in the Y-axial direction (ld), that in the X-axial direction (wd), and that in the Z-axial direction (hd) were 105 μm, 130 μm, and 160 μm, respectively. The inductance (L value) and Q value of the produced sample were measured under the same conditions as in Test Example 1. The measured L value was 2.6 nH and the measured Q value was 29.

Test Example 6

Another sample was produced under the same conditions as in Test Example 1 except that the length (La), width (Wa) and height (Ha) of the insulator were 265 μm, 200 μm, and 300 μm, respectively and the core portion dimension in the Y-axial direction (ld), that in the X-axial direction (wd), and that in the Z-axial direction (hd) were 95 μm, 130 μm, and 170 μm, respectively. The inductance (L value) and Q value of the produced sample were measured under the same conditions as in Test Example 1. The measured L value was 2.3 nH and the measured Q value was 28.

Test Example 7

A sample of coil component having an insulator formed of resin and a coil portion was produced. Their dimensions were as follows:

Insulator: a length (La) 410 μm; a width (Wa) 200 μm; a height (Ha) 195 μm

Coil portion: a conductor dimension in the Y-axial direction (lc) 35 μm; a conductor dimension in the X-axial direction (wc) 24 μm; a conductor dimension in the Z-axial direction (hc) 35 μm; an inter-conductor distance g 10 μm; a core portion dimension in the Y-axial direction (ld) 250 μm; a core portion dimension in the X-axial direction (wd) 160 μm; a core portion dimension in the Z-axial direction (hd) 85 μm Side margin: a Y-axis margin (lb) 45 μm; an X-axis margin (wb) 20 μm; a Z-axis margin (hb) 20 μm.

The inductance (L value) and Q value of the produced sample were measured under the same conditions as in Test Example 1. The measured L value was 3.0 nH and the measured Q value was 31.

Test Example 8

Another sample was produced under the same conditions as in Test Example 7 except that the length (La), width (Wa) and height (Ha) of the insulator were 380 μm, 200 μm, and 210 μm, respectively and the core portion dimension in the Y-axial direction (ld), that in the X-axial direction (wd), and that in the Z-axial direction (hd) were 220 μm, 160 μm, and 100 μm, respectively. The inductance (L value) and Q value of the produced sample were measured under the same conditions as in Test Example 1. The measured L value was 3.2 nH and the measured Q value was 32.

Test Example 9

Another sample was produced under the same conditions as in Test Example 7 except that the length (La), width (Wa) and height (Ha) of the insulator were 350 μm, 200 μm, and 230 μm, respectively and the core portion dimension in the Y-axial direction (ld), that in the X-axial direction (wd), and that in the Z-axial direction (hd) were 190 μm, 160 μm, and 120 μm, respectively. The inductance (L value) and Q value of the produced sample were measured under the same conditions as in Test Example 1. The measured L value was 3.3 nH and the measured Q value was 33.

Test Example 10

Another sample was produced under the same conditions as in Test Example 7 except that the length (La), width (Wa) and height (Ha) of the insulator were 320 μm, 200 μm, and 250 μm, respectively and the core portion dimension in the Y-axial direction (ld), that in the X-axial direction (wd), and that in the Z-axial direction (hd) were 160 μm, 160 μm, and 140 μm, respectively. The inductance (L value) and Q value of the produced sample were measured under the same conditions as in Test Example 1. The measured L value was 3.4 nH and the measured Q value was 34.

Test Example 11

Another sample was produced under the same conditions as in Test Example 7 except that the length (La), width (Wa) and height (Ha) of the insulator were 310 μm, 200 μm, and 260 μm, respectively and the core portion dimension in the Y-axial direction (ld), that in the X-axial direction (wd), and that in the Z-axial direction (hd) were 150 μm, 160 μm, and 150 μm, respectively. The inductance (L value) and Q value of the produced sample were measured under the same conditions as in Test Example 1. The measured L value was 3.5 nH and the measured Q value was 34.

Test Example 12

Another sample was produced under the same conditions as in Test Example 7 except that the length (La), width (Wa) and height (Ha) of the insulator were 275 μm, 200 μm, and 290 μm, respectively and the core portion dimension in the Y-axial direction (ld), that in the X-axial direction (wd), and that in the Z-axial direction (hd) were 115 μm, 160 μm, and 180 μm, respectively. The inductance (L value) and Q value of the produced sample were measured under the same conditions as in Test Example 1. The measured L value was 3.3 nH and the measured Q value was 32.

Test Example 13

Another sample was produced under the same conditions as in Test Example 7 except that the length (La), width (Wa) and height (Ha) of the insulator were 255 μm, 200 μm, and 315 μm, respectively and the core portion dimension in the Y-axial direction (ld), that in the X-axial direction (wd), and that in the Z-axial direction (hd) were 95 μm, 160 μm, and 205 μm, respectively. The inductance (L value) and Q value of the produced sample were measured under the same conditions as in Test Example 1. The measured L value was 3.1 nH and the measured Q value was 31.

Test Example 14

Another sample was produced under the same conditions as in Test Example 7 except that the length (La), width (Wa) and height (Ha) of the insulator were 310 μm, 200 μm, and 260 μm, respectively; the conductor dimension in the Y-axial direction (lc), that in the X-axial direction (wc), and that in the Z-axial direction (hc) were 30 μm, 24 μm, and 30 μm, respectively; and the core portion dimension in the Y-axial direction (ld), that in the X-axial direction (wd), and that in the Z-axial direction (hd) were 160 μm, 160 μm, and 160 μm, respectively. The inductance (L value) and Q value of the produced sample were measured under the same conditions as in Test Example 1. The measured L value was 3.6 nH and the measured Q value was 36.

Test Example 15

Another sample was produced under the same conditions as in Test Example 7 except that the length (La), width (Wa) and height (Ha) of the insulator were 310 μm, 200 μm, and 260 μm, respectively; the conductor dimension in the Y-axial direction (lc), that in the X-axial direction (wc), and that in the Z-axial direction (hc) were 25 μm, 24 μm, and 25 μm, respectively; and the core portion dimension in the Y-axial direction (ld), that in the X-axial direction (wd), and that in the Z-axial direction (hd) were 170 μm, 160 μm, and 170 μm, respectively. The inductance (L value) and Q value of the produced sample were measured under the same conditions as in Test Example 1. The measured L value was 3.8 nH and the measured Q value was 37.

Test Example 16

Another sample was produced under the same conditions as in Test Example 7 except that the length (La), width (Wa) and height (Ha) of the insulator were 310 μm, 200 μm, and 260 μm, respectively; the conductor dimension in the Y-axial direction (lc), that in the X-axial direction (wc), and that in the Z-axial direction (hc) were 20 μm, 24 μm, and 20 μm, respectively; and the core portion dimension in the Y-axial direction (ld), that in the X-axial direction (wd), and that in the Z-axial direction (hd) were 180 μm, 160 μm, and 180 μm, respectively. The inductance (L value) and Q value of the produced sample were measured under the same conditions as in Test Example 1. The measured L value was 4.2 nH and the measured Q value was 37.

Test Example 17

Another sample was produced under the same conditions as in Test Example 7 except that the length (La), width (Wa) and height (Ha) of the insulator were 310 μm, 200 μm, and 260 μm, respectively; the conductor dimension in the Y-axial direction (lc), that in the X-axial direction (wc), and that in the Z-axial direction (hc) were 15 μm, 24 μm, and 15 μm, respectively; and the core portion dimension in the Y-axial direction (ld), that in the X-axial direction (wd), and that in the Z-axial direction (hd) were 190 μm, 160 μm, and 190 μm, respectively. The inductance (L value) and Q value of the produced sample were measured under the same conditions as in Test Example 1. The measured L value was 4.8 nH and the measured Q value was 36.

Comparative Example 1

Another sample was produced under the same conditions as in Test Example 1 except that the length (La), width (Wa) and height (Ha) of the insulator were 400 μm, 200 μm, and 200 μm, respectively and the core portion dimension in the Y-axial direction (ld), that in the X-axial direction (wd), and that in the Z-axial direction (hd) were 230 μm, 130 μm, and 70 μm, respectively. The inductance (L value) and Q value of the produced sample were measured under the same conditions as in Test Example 1. The measured L value was 2.2 nH and the measured Q value was 22.

Comparative Example 2

Another sample was produced under the same conditions as in Test Example 1 except that the length (La), width (Wa) and height (Ha) of the insulator were 407 μm, 200 μm, and 202 μm, respectively and the core portion dimension in the Y-axial direction (ld), that in the X-axial direction (wd), and that in the Z-axial direction (hd) were 237 μm, 130 μm, and 72 μm, respectively. The inductance (L value) and Q value of the produced sample were measured under the same conditions as in Test Example 1. The measured L value was 2.3 nH and the measured Q value was 23.

The conditions, dimension ratios, the areas of the insulator and the coil portion as viewed from the coil axial direction (X-axial direction), the ratio of the areas, and coil characteristics of the Test Examples 1-17 and the Comparative Example 1-2 are summarized in Tables 1-3 below.

TABLE 1

| | | Insulator | | | Side Margin | | | Internal Conductor | | Inter-conductor Distance | |
|---|---|---|---|---|---|---|---|---|---|---|---|
| | | La [μm] | Wa [μm] | Ha [μm] | lb [μm] | wb [μm] | hb [μm] | lc [μm] | wc [μm] | hc [μm] | g [μm] |
| Comparative Example 1 | glass | 400 | 200 | 200 | 50 | 30 | 30 | 35 | 10 | 35 | 20 |
| Comparative Example 2 | glass | 407 | 200 | 202 | 50 | 30 | 30 | 35 | 10 | 35 | 20 |
| Test Sample 1 | glass | 370 | 200 | 215 | 50 | 30 | 30 | 35 | 10 | 35 | 20 |
| Test Sample 2 | glass | 350 | 200 | 230 | 50 | 30 | 30 | 35 | 10 | 35 | 20 |
| Test Sample 3 | glass | 320 | 200 | 250 | 50 | 30 | 30 | 35 | 10 | 35 | 20 |
| Test Sample 4 | glass | 305 | 200 | 265 | 50 | 30 | 30 | 35 | 10 | 35 | 20 |
| Test Sample 5 | glass | 275 | 200 | 290 | 50 | 30 | 30 | 35 | 10 | 35 | 20 |
| Test Sample 6 | glass | 265 | 200 | 300 | 50 | 30 | 30 | 35 | 10 | 35 | 20 |
| Test Sample 7 | resin | 410 | 200 | 195 | 45 | 20 | 20 | 35 | 24 | 35 | 10 |
| Test Sample 8 | resin | 380 | 200 | 210 | 45 | 20 | 20 | 35 | 24 | 35 | 10 |
| Test Sample 9 | resin | 350 | 200 | 230 | 45 | 20 | 20 | 35 | 24 | 35 | 10 |
| Test Sample 10 | resin | 320 | 200 | 250 | 45 | 20 | 20 | 35 | 24 | 35 | 10 |
| Test Sample 11 | resin | 310 | 200 | 260 | 45 | 20 | 20 | 35 | 24 | 35 | 10 |
| Test Sample 12 | resin | 275 | 200 | 290 | 45 | 20 | 20 | 36 | 24 | 35 | 10 |
| Test Sample 13 | resin | 255 | 200 | 315 | 45 | 20 | 20 | 35 | 24 | 35 | 10 |
| Test Sample 14 | resin | 310 | 200 | 260 | 45 | 20 | 20 | 30 | 24 | 30 | 10 |
| Test Sample 15 | resin | 310 | 200 | 260 | 45 | 20 | 20 | 25 | 24 | 25 | 10 |
| Test Sample 16 | resin | 310 | 200 | 260 | 45 | 20 | 20 | 20 | 24 | 20 | 10 |
| Test Sample 17 | resin | 310 | 200 | 260 | 45 | 20 | 20 | 15 | 24 | 15 | 10 |

TABLE 2

| | Core Portion Dimension | | | Dimensional Ratio | | |
|---|---|---|---|---|---|---|
| | ld [μm] | wd [μm] | hd [μm] | Ha/La X | hd/ld Y | X/Y |
| Comparative Example 1 | 230 | 130 | 70 | 0.5 | 0.3 | 1.6 |
| Comparative Example 2 | 237 | 130 | 72 | 0.5 | 0.3 | 1.6 |
| Test Sample 1 | 200 | 130 | 85 | 0.6 | 0.4 | 1.4 |
| Test Sample 2 | 180 | 130 | 100 | 0.7 | 0.6 | 1.2 |
| Test Sample 3 | 150 | 130 | 120 | 0.8 | 0.8 | 1.0 |
| Test Sample 4 | 135 | 130 | 135 | 0.9 | 1.0 | 0.9 |
| Test Sample 5 | 105 | 130 | 160 | 1.1 | 1.5 | 0.7 |
| Test Sample 6 | 95 | 130 | 170 | 1.1 | 1.8 | 0.6 |
| Test Sample 7 | 250 | 160 | 85 | 0.5 | 0.3 | 1.4 |
| Test Sample 8 | 220 | 160 | 100 | 0.6 | 0.5 | 1.2 |

TABLE 2-continued

| | Core Portion Dimension | | | Dimensional Ratio | | |
|---|---|---|---|---|---|---|
| | ld [μm] | wd [μm] | hd [μm] | Ha/La X | hd/ld Y | X/Y |
| Test Sample 9 | 190 | 160 | 120 | 0.7 | 0.6 | 1.0 |
| Test Sample 10 | 160 | 160 | 140 | 0.8 | 0.9 | 0.9 |
| Test Sample 11 | 150 | 160 | 150 | 0.8 | 1.0 | 0.8 |
| Test Sample 12 | 115 | 160 | 180 | 1.1 | 1.6 | 0.7 |
| Test Sample 13 | 95 | 160 | 205 | 1.2 | 2.2 | 0.6 |
| Test Sample 14 | 160 | 160 | 160 | 0.8 | 1.0 | 0.8 |
| Test Sample 15 | 170 | 160 | 170 | 0.8 | 1.0 | 0.8 |
| Test Sample 16 | 180 | 160 | 180 | 0.8 | 1.0 | 0.8 |
| Test Sample 17 | 190 | 160 | 190 | 0.8 | 1.0 | 0.8 |

TABLE 3

| | Insulator Area | Core Portion Area | Area Ratio | Core Portion Area as Compared to | Results | |
|---|---|---|---|---|---|---|
| | Sa [μm2] | Sd [μm2] | Sd/Sa [%] | Comparative Example 1. [%] | L Value [nH] | Q Value — |
| Comparative Example 1 | 80000 | 16100 | 20 | | 2.2 | 22 |
| Comparative Example 2 | 82214 | 17064 | 21 | 1.06 | 2.3 | 23 |
| Test Sample 1 | 79550 | 17000 | 21 | 1.06 | 2.6 | 27 |
| Test Sample 2 | 80500 | 18000 | 22 | 1.12 | 2.7 | 28 |
| Test Sample 3 | 80000 | 18000 | 23 | 1.12 | 2.8 | 29 |
| Test Sample 4 | 80825 | 18225 | 23 | 1.13 | 2.9 | 30 |
| Test Sample 5 | 79750 | 16800 | 21 | 1.04 | 2.6 | 29 |
| Test Sample 6 | 79500 | 16150 | 20 | 1.00 | 2.3 | 28 |
| Test Sample 7 | 79950 | 21250 | 27 | 1.32 | 3.0 | 31 |
| Test Sample 8 | 79800 | 22000 | 28 | 1.37 | 3.2 | 32 |
| Test Sample 9 | 80500 | 22800 | 28 | 1.42 | 3.3 | 33 |
| Test Sample 10 | 80000 | 22400 | 28 | 1.39 | 3.4 | 34 |
| Test Sample 11 | 80600 | 22500 | 28 | 1.40 | 3.5 | 34 |
| Test Sample 12 | 79750 | 20700 | 26 | 1.29 | 3.3 | 32 |
| Test Sample 13 | 80325 | 19475 | 24 | 1.21 | 3.1 | 31 |
| Test Sample 14 | 80600 | 25600 | 32 | 1.59 | 3.6 | 36 |

TABLE 3-continued

| | Insulator Area | Core Portion Area | Area Ratio | Core Portion Area as Compared to | Results | |
|---|---|---|---|---|---|---|
| | Sa [μm2] | Sd [μm2] | Sd/Sa [%] | Comparative Example 1. [%] | L Value [nH] | Q Value — |
| Test Sample 15 | 80600 | 28900 | 36 | 1.80 | 3.8 | 37 |
| Test Sample 16 | 80600 | 32400 | 40 | 2.01 | 4.2 | 37 |
| Test Sample 17 | 80600 | 36100 | 45 | 2.24 | 4.8 | 36 |

As shown in Tables 2 and 3, it was confirmed that the Test Samples 1-17 having the insulator's dimensional ratio (Ha/La) equal to or less than 1.5 times the core portion's dimensional ratio (hd/ld) each had a higher Q value than the Comparative Examples 1-2 having the dimensional ratio (Ha/La) of the insulator exceeding 1.5 times the dimensional ratio (hd/ld) of the core portion.

Also, it was confirmed that the Test Samples 3-5 having the core portion's dimensional ratio (hd/ld) of 0.8 to 1.5 each had a Q value (of 29 or higher) higher than the Test Samples 1, 2, and 6. Likewise, it was confirmed that the Test Samples 9-11 and 14-17 having the core portion's dimensional ratio (hd/ld) of 0.6 to 1.0 each had a Q value (of 32 or higher) higher than the Test Samples 7, 8, 12, and 13.

Also, it was confirmed that the Test Samples 2-4 having the core portion's dimensional ratio (hd/ld) of 0.6 to 1.0 each had an L value (of 2.7 nH or higher) greater than the Test Samples 1, 5, and 6.

In addition, it was confirmed that the Test Samples 2-4 and 7-17 having the ratio (Sd/Sa) of the core portion's area (Sd) with respect to the insulator's area (Sa) of 22% to 45% each had a high L value of 2.7 nH or more.

The Test Sample 1 had a Q value higher than that of the Comparative Example 2 although their core portion areas were almost the same as each other because the core portion dimensional ratio (wd/ld) of the Test Sample 1 was greater than that of the Comparative Example 2.

The Test Sample 4, with the core portion's dimensional ratio (wd/ld) of about 1, had the highest Q value amonth the Test Samples 1-6.

Since the Test Samples 7-17 each had an insulator portion with insulating quality higher than the Test Samples 1-6 and thus the conductor dimensions of the Test Samples 7-17 may be formed to the largest extent possible, the Test Samples 7-17 may exhibit a high inductance value. Accordingly, the Q values may become 31 or higher.

The invention is not limited to the above described embodiments and various modification can be made.

For example, in the embodiments described above, the insulating layers and the via conductive members are alternately layered from the top surface side to the bottom surface side to fabricate the coil component. Alternatively the insulating layers and the via conductive members may be layered from the bottom surface side to the top surface side.

Each of the circumference sections of the coil portion may be layered in the coil axial direction. The production method is also applicable to the present invention.

In the above embodiment, the shape of the circumference section as viewed from the Z-axial direction is rectangular. Alternatively, the circumference section may be formed in a polygonal shape, and those shapes may have rounded corners to have the same advantageous effects.

While the coil axis of the coil component extends in the X-axial direction (width direction) in the above embodiment, the coil component may be formed such that the coil axis extends in the Z-axial direction (height direction) to obtain the same advantageous effects.

The insulator may provide the same advantageous effect whether it is formed of glass or resin and includes ferrite powder to the extent that the magnetic permeability thereof is 2 or less. The insulator with a relative permittivity of five or less can improve high frequency characteristics. The insulator with a relative permittivity of four or less can enhance the Q value at a high frequency by reducing the floating capacitance generated between the terminal electrodes.

Second Embodiment

While the electronic components equipped with the comb-tooth block portion have been described as the first embodiment, the comb-tooth block portion 24 is optional and the electronic components in accordance with some aspects of the present invention do not necessarily include the comb-tooth block portion 24. Such electronic components will be described below as an exemplary variation. In the following exemplary arrangement, the ratio (Ha/La) of the height (Ha) of the insulator part 10 to the length (La) of the insulator is 1.5 times or less of the ratio (hd/ld) of the height (hd) between the inner peripheral portions of the circumference section Cn along the Z-axial direction with respect to the length (ld) between the inner peripheral portions of the circumference section Cn along the Y-axial direction.

The opening dimensional ratio (hd/ld) of the circumference section Cn may be, for example, 0.6 to 1.0. It should be noted that the opening dimensional ratio (Hd/ld) is not limited to the above range. Thus, it is possible to stably secure a high inductance value and Q value.

The ratio (Sd/Sa) of the area (Sd) partitioned by the inner circumferential portion of the circumferential section Cn with respect to the area (Sa) of the insulator portion as viewed from the coil axial direction (X-axial direction) may be, for example, 0.22 to 0.65 (22% to 65%). It should be noted that the ratio (Sd/Sa) is not limited to the above range. Thus, the inductance value of the coil component may be efficiently enhanced.

First Arrangement

The electronic components according to the first arrangement does not include any comb-tooth block portion. Thus, the coil portion may be laid out in a wider area in an insulator with a given volume as compared to the coil component having such a comb-tooth block portion and increase the opening area of the coil portion, thereby enhancing its L value and Q value.

The electronic component according to this arrangement enables its external electrodes to be disposed only on a single surface of the cuboid insulator thanks to absence of a comb-tooth block portion. Thus, the electronic component according to this arrangement may be a single-surface-mounted type component. The coil components according to the first embodiment is a three-surface-mounted type electronic component having its electrodes provided on the three surfaces 102. 103, 104 of the rectangular insulator. However, the configuration is not limiting. The electronic component may be a single-surface-mounted type component having its external electrodes disposed only on a single surface of the insulator, as in this arrangement. Moreover, while the coil portion and the external electrodes are connected via the extended portions and the comb-tooth block portions in the first embodiment, the connections between the coil portion and the external electrodes in this arrangement are provided by connecting via conductive layers.

Figure 12A:
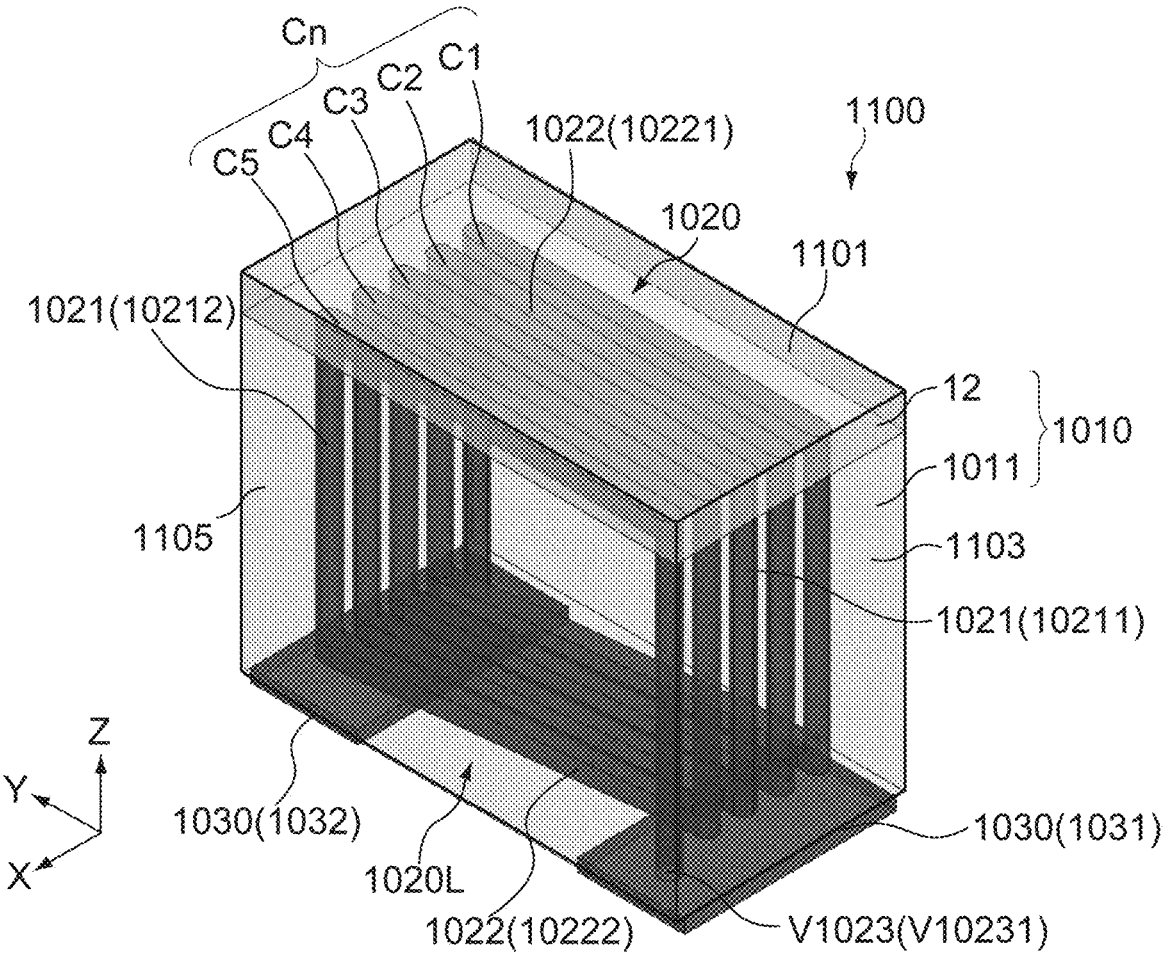
FIG. 12A is a schematic perspective view of an electronic component according to the first arrangement of another embodiment of the disclosure.
Figure 12B:
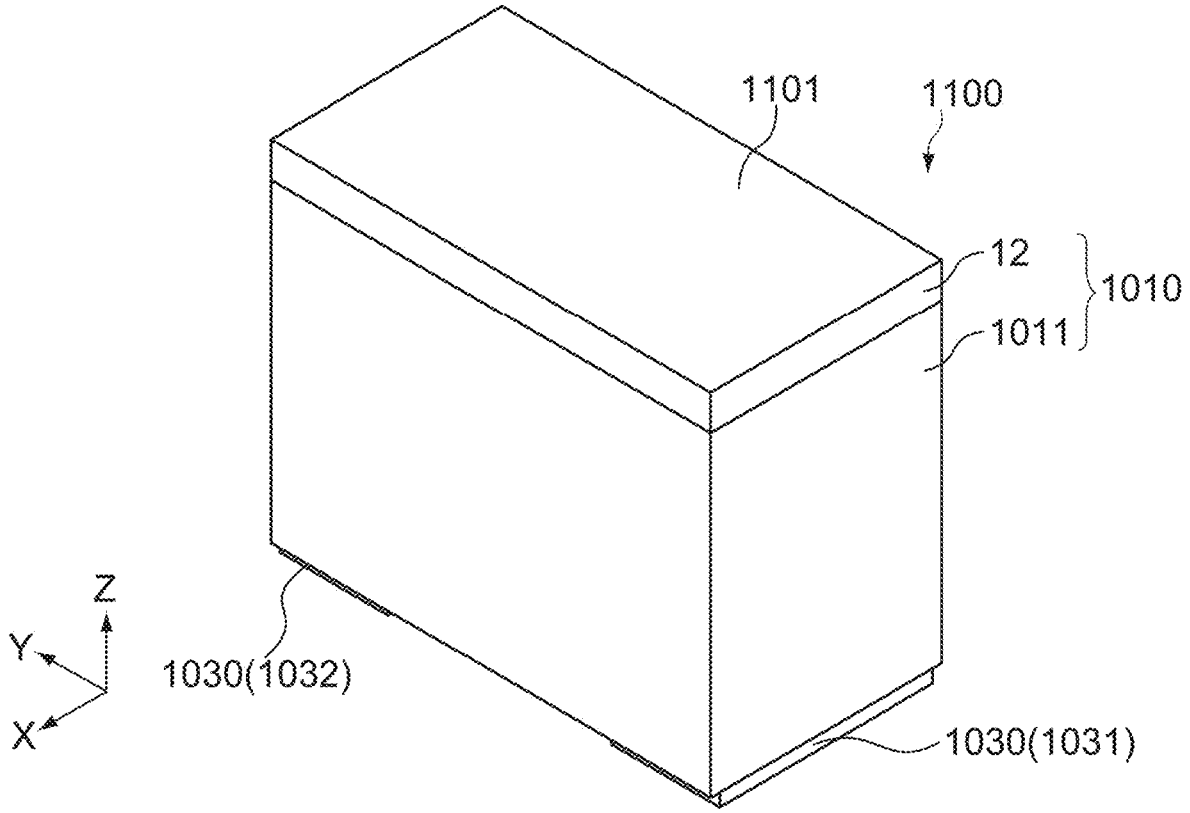
FIG. 12B is an external perspective view of the electronic component of FIG. 12A.
Figure 13A:
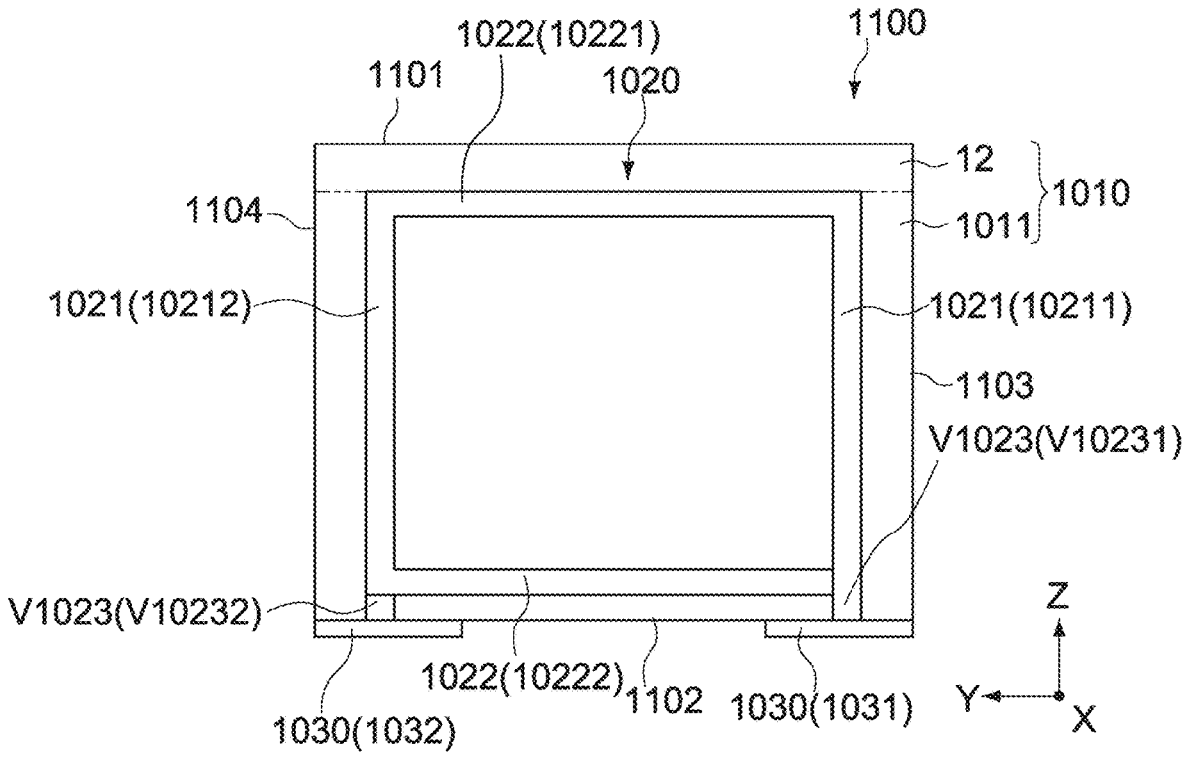
FIG. 13A is a schematic perspective side view of the electronic component of FIG. 12A.
Figure 13B:
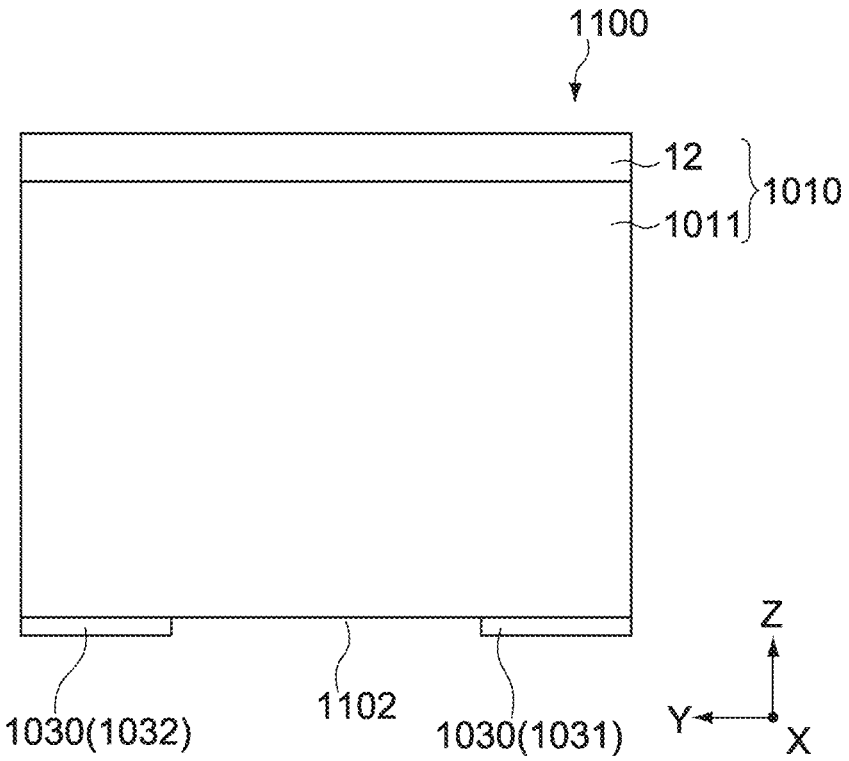
FIG. 13B is a schematic external side view of the electronic component of FIG. 12B.
Figure 14:
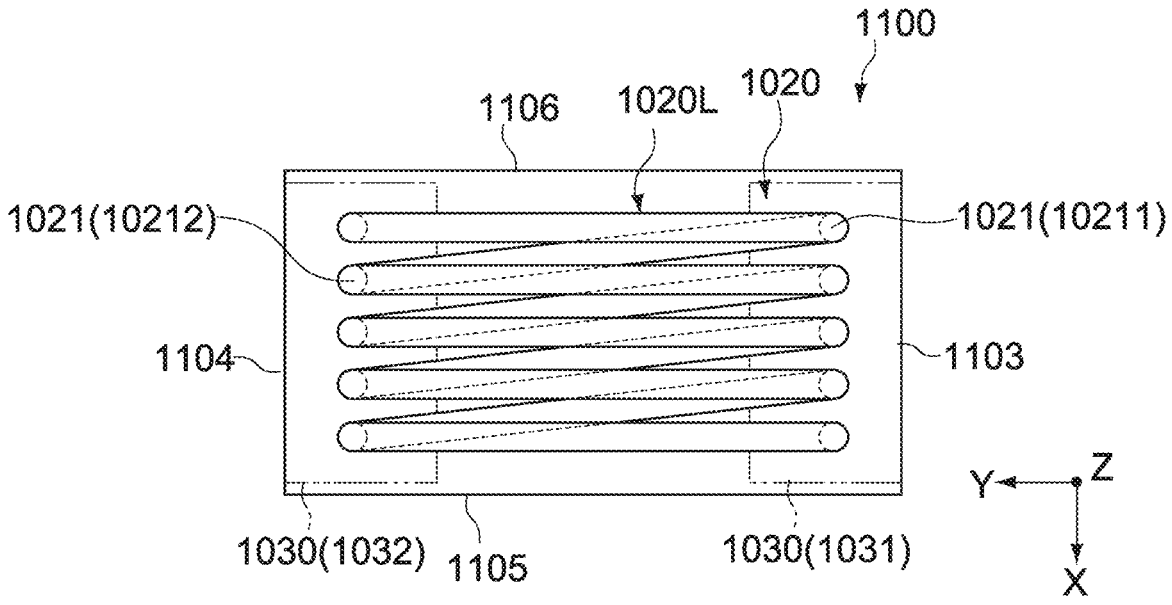
FIG. 14 is a schematic perspective top view of the electronic component of FIG. 12A.

Next, the electronic components according to the first arrangement will be described with reference to FIGS. 12-14. FIG. 12A is a schematic perspective view of an electronic component according to the first arrangement of this embodiment FIG. 12B is an external perspective view of the electronic component of FIG. 12A; FIG. 13A is a schematic perspective side view of the electronic component of FIG. 12A; FIG. 13B is a schematic external side view of the electronic component of FIG. 12B; and FIG. 14 is a schematic perspective top view of the electronic component of FIG. 12B. In these drawings, the X-axis, Y-axis and Z-axis indicate three axial directions that are perpendicular to each other.

An electronic component 1100 according to this arrangement may be configured as a coil component that is surface-mounted on a substrate. The electronic component 1100 may include an insulator 1010, an internal conductor 1020, and an external electrode 1030.

The insulator 1010 may include a top surface 1101, a bottom surface 1102, a first end surface 1103, a second end surface 1104, a first side surface 1105, and a second side surface 1106. The insulator 10 is made in a cuboid shape that has the width in the X-axial direction, the length in the Y-axial direction and the height in the Z-axial direction. The bottom surface 1102 may serve as a mounting surface.

The insulator 1010 may include a body 1011 and an upper portion 12. The body 1011 may include the internal conductor 1020 thereinside and form a main part of the insulator 1010. The upper portion 12 provides the top surface 1101 of the insulator 1010. The insulator 1010 may be formed of the same material as the above embodiments.

The internal conductor 1020 may be provided inside the insulator 1010. The internal conductor 1020 may include a plurality of pillared conductive members 1021, a plurality of connecting conductive members 1022, and a plurality of connecting via conductive layers V1023. The plurality of pillared conductive members 1021 and the plurality of connecting conductive members 1022 together form a coil portion 1020L. The plurality of connecting via conductive layers V1023 may be connected to the both ends of the coil portion 1020L, respectively.

The plurality of pillared conductive members 1021 may be each formed in a substantially columnar shape with a central axis arranged in parallel with the Z-axial direction. The plurality of pillared conductive members 1021 may include two groups of the conductors that are arranged so as to face to each other in the substantially Y-axial direction. One of the two conductor groups is first pillared conductive members 10211. The first pillared conductive members 211 are arranged in the X-axial direction at a predetermined interval The other of the two conductor groups is second pillared conductive members 10212. The second pillared conductive members 212 are also arranged in the X-axial direction at a predetermined interval.

The substantially columnar shape herein may include any columnar shape of which cross section perpendicular to the axis (in the direction perpendicular to the central axis) is a circle, an ellipse, or an oval. For example, the substantially columnar shape may mean any prism whose cross section is an ellipse or an oval in which the ratio of the major axis to the minor axis is 3 or smaller.

The first pillared conductive members 10211 and the second pillared conductive members 10212 may be configured to have the same radius and the same height respectively. The illustrated example includes five of the first pillared conductive members 10211 and five of the second pillared conductive members 10212. As will be further described later, the first and second pillared conductive members 10211, 10212 may be formed by stacking two or more via conductive members in the Z-axial direction.

Note that the reason why the pillared members have the substantially same radius is to prevent increase of resistance and this may be realized by reducing variation in the dimension of the pillared members as viewed in the same direction to 10% or smaller. Moreover the reason why the pillared members have the substantially same height is to secure stacking accuracy of the layers and this may be realized by reducing a difference in the height of the pillared members to, for example, 10 μm or smaller.

The plurality of connecting conductive members 1022 may include two groups of conductors that are formed in parallel with the XY plane and arranged so as to face to each other in the Z-axial direction. One of the two conductor group is first connecting conductive members 10221 that extend along the Y-axial direction and are arranged in the X-axial direction at a predetermined interval so as to connect between the first pillared conductive members 10211 and the second pillared conductive members 10212 respectively. The other of the two conductor group is second connecting conductive members 10222 that extend at a predetermined angle with the Y-axial direction and are arranged in the X-axial direction at a predetermined interval so as to connect between the first pillared conductive members 10211 and the second pillared conductive members 10212 respectively. The illustrated example includes five of the first connecting conductive members 10221 and five of the second connecting conductive members 10222.

Referring aging to FIG. 12, the first connecting conductive members 10221 are each connected with upper ends of a predetermined pair of the pillared conductive members 10211, 10212, and the second connecting conductive members 10222 are each connected with lower ends of a predetermined pair of the pillared conductive members 10211, 10212. More specifically, the first and second pillared conductive members 10211, 10212 and the first and second connecting conductive members 10221, 10222 may be each connected to each other so as to form circumference sections Cn (C1-C5) of the coil portion 1020L and such that the circumference sections Cn form a rectangular helix in the X-axial direction. In this manner, provided inside the insulator 1010 is the coil portion 1020L that has the central axis (a coil axis) in the X-axial direction and has an rectangular opening.

In this embodiment, the circumference sections Cn include five circumference sections C1-C5. The cross section of each of The circumference sections C1-C5 may have a substantially same cross section.

The connecting via conductive layers V1023 include first connecting via conductive layer V10231 and second connecting via conductive layer V10232. The first connecting via conductive layer V10231 may be coupled to a lower end of the first pillared conductive member 10211 that forms one end of the coil portion 1020L, and the second connecting via conductive layer V102312 may be coupled to a lower end of the second pillared conductive member 10212 that forms the other end of the coil portion 1020L. The first and second connecting via conductive layers V10231 and V10232 each have a substantially circular cross-sectional shape along the plane orthogonal to the Z-axial direction. The cross section of the first and second connecting via conductive layers V10231 and V10232 each have the same shape and area as that of the pillared conductive member 1021.

The external electrode 1030 may form an external terminal for surface mounting. The external electrode 30 may include first and second external electrodes 1031, 1032 that face to each other in the Y-axial direction. The first and second external electrodes 1031, 1032 may be formed only on the bottom surface 1102. The bottom surface 1102 is one of the surfaces of the insulator 1010. The external electrode 1030 may be formed outside the insulator 1010.

The pillared conductive members 1021, the connecting conductive members 1022, and the connecting via conductive layer V1023 may be formed of a metal such as Cu (copper), Al (aluminum), Ni (nickel) or the like. In this embodiment, these may be formed of copper or a copper alloy plated layer. The first and second external electrodes 1031, 1032 may be formed by, for example, Ni/Sn plating.

Figure 15:
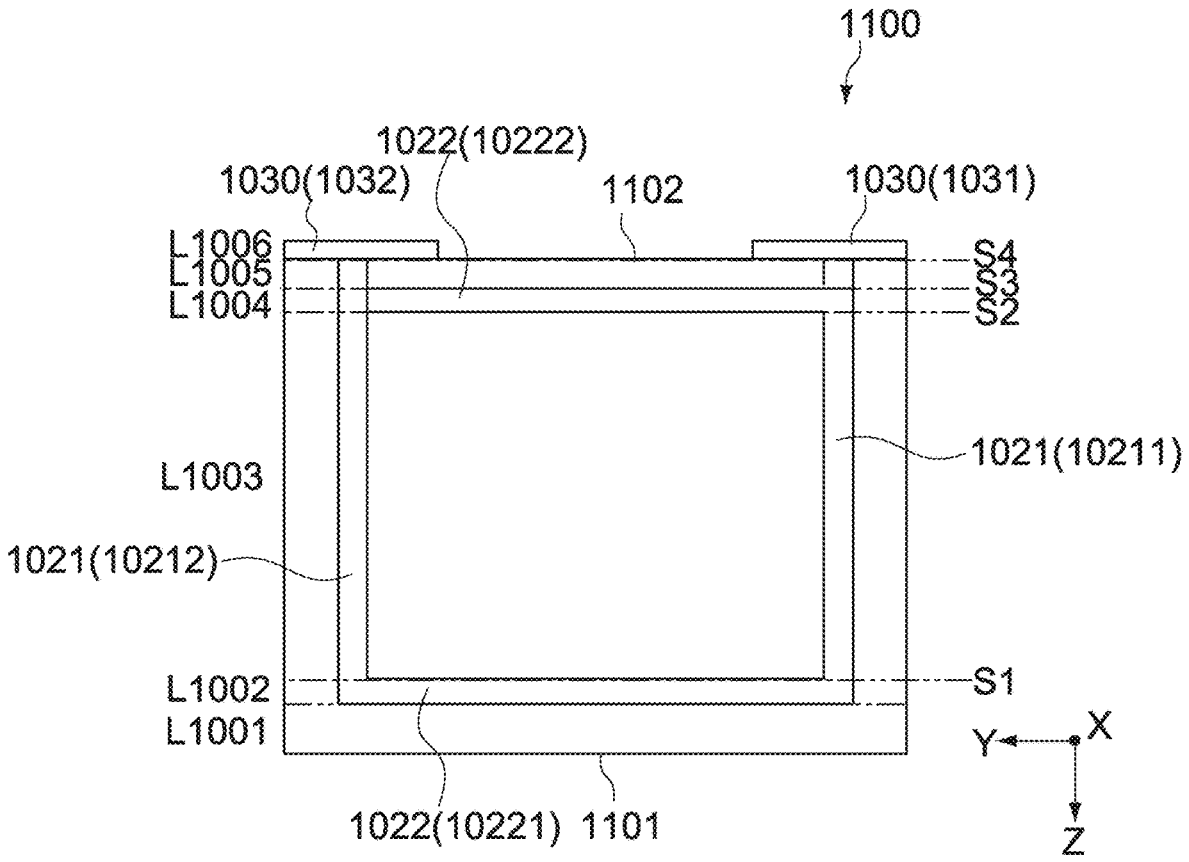
FIG. 15 is a schematic perspective side view of the upside-down electronic component of FIG. 12A.

FIG. 15 is a schematic side view of the upside-down electronic component 1100. As shown in FIG. 15, the electronic component 1100 may include a film layer L1001 and electrode layers L1002-L1006. In the embodiment, the film layer L001 and the electrode layers L1002-L1006 may be stacked sequentially in the Z-axial direction from the top surface 1101 to the bottom surface 1102. The number of the layers may not be particularly limited and may be six in this example.

The film layer L1001 and the electrode layers L1002-L1006 may include corresponding insulator 1010, internal conductor 1020 and external electrode 1030. FIGS. 16A-16F are schematic top views of the film layer L1001 and the electrode layers L1002-L1006 of FIG. 15.

Figure 16A:
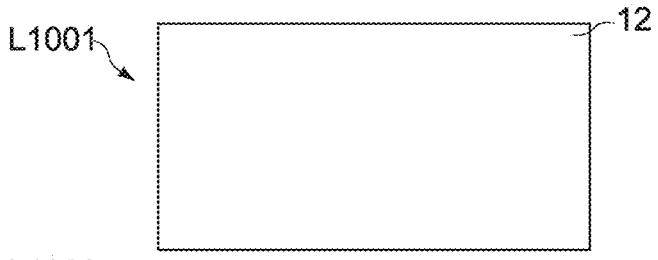
FIGS. 16A to 16F illustrate schematic top views of electrode layers included in the electronic component.
Figure 16B:
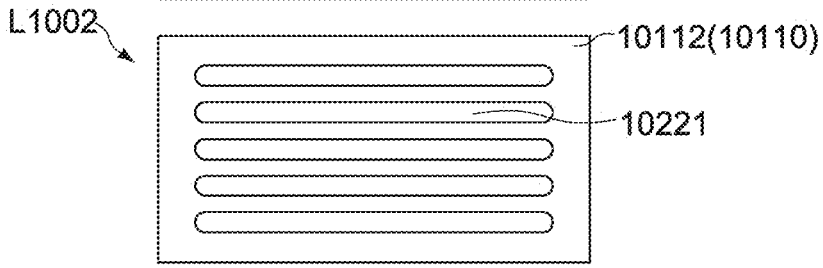
Figure 16C:
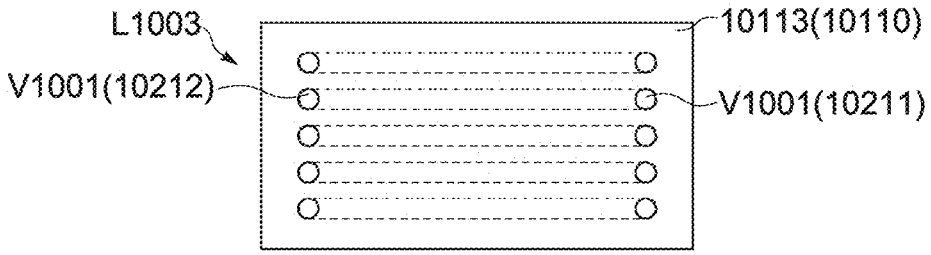
Figure 16D:
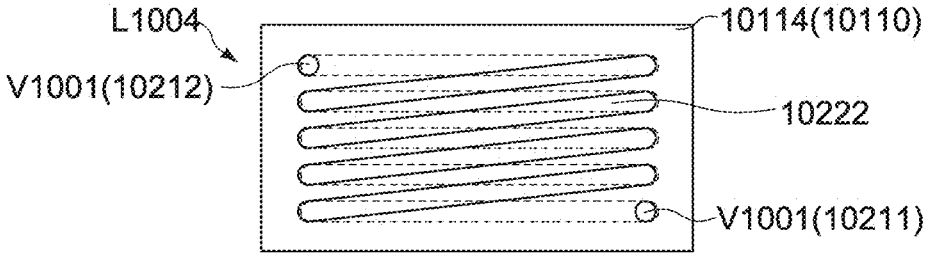
Figure 16E:
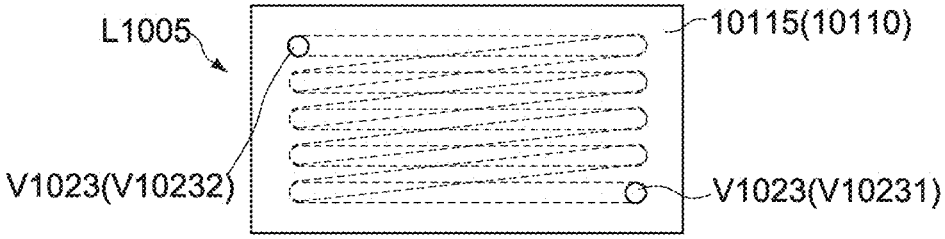
Figure 16F:
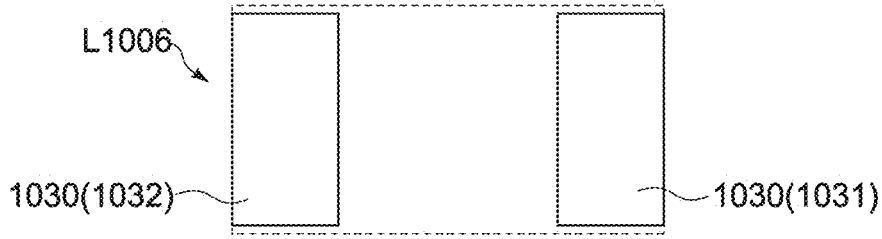

The film layer L1001 may be formed of the upper portion 12 that serves as the top surface 1101 of the insulator 1010 (FIG. 16A). The electrode layer L1002 may include an insulating layer 10110 (10112) and the first pillared conductive members 211 (FIG. 16B). The insulating layer 10110 (10112) forms a part of the insulator 10110 (the body 1011). The electrode layer L1003 may include the insulating layer 10110 (10113), and via conductive members V1001 that form a part of the pillared conductive members 10211, 10212 (FIG. 16C). The electrode layer L1004 may include the insulating layer 10110 (10114), the via conductive member V1001, and the second connecting conductive member 10222 (FIG. 16D). The electrode layer L1005 may include the insulating layer 10110 (10115) and the connecting via conductive layers V1023 (the first connecting via conductive layer V10231 and the second connecting via conductive layer V10232)(FIG. 16E). The electrode layer L1006 may include the external electrodes 1030 (the first external electrode 1031 and the second external electrode 1032) (FIG. 16F).

The electrode layers L1002-L1006 may be stacked in the height direction with bonding surfaces S1-S4 (see FIG. 15) interposed therebetween. Accordingly, the insulating layers 10110, the via conductive members V1001, the connecting via conductive layers 1023 and the external electrodes 1030 also have boundaries in the height direction. The electronic component 1100 may be manufactured by the same build-up method as described in connection with the above embodiment in which the electrode layers L10a02-L1006 are sequentially fabricated and layered in the stated order from the electrode layer L1002.

As described above, the electronic component 1100 according to the first arrangement may have a larger dimension (ld) of the core portion in the Y-axial direction thanks to absence of comb-tooth block portions. Thus, the coil portion 1020L may have a larger opening area, thereby enhancing the L value and Q value.

Moreover, since the external electrodes 1030 serving as external terminals for surface mounting are provided only on the single surface of the electronic component 1100, a formation of solder fillet may be prevented when solder-mounting the electronic component 1100, thereby enabling a high-density mounting.

In addition, the coil portion 1020L and the external electrodes 1030 are connected through the connecting via conductive layers V1023, the path of electric current from the external electrodes to the coil portion 1020 may be shortened as compared to the embodiments with comb-tooth block portions. Thus, an electronic component 1100 generating less noise and having less degradation in characteristics may be obtained.

Second Arrangement

The coil components according to the first arrangement have the connecting via conductive layers V1023 having a substantially circular cross-sectional shape along the plane orthogonal to the Z-axial direction. However, the cross-sectional shape is not limiting. The connecting via conductive layers may have a oval cross-sectional shape, as in the second arrangement described below. Structures different from the first arrangement will be hereinafter mainly described The same reference numerals are given to the same elements as those of the first arrangement, and the description thereof will be omitted or simplified. The coil component according to this arrangement may also have a coil portion having a large opening area like the first arrangement, thereby enhancing the L value and Q value.

Figure 17:
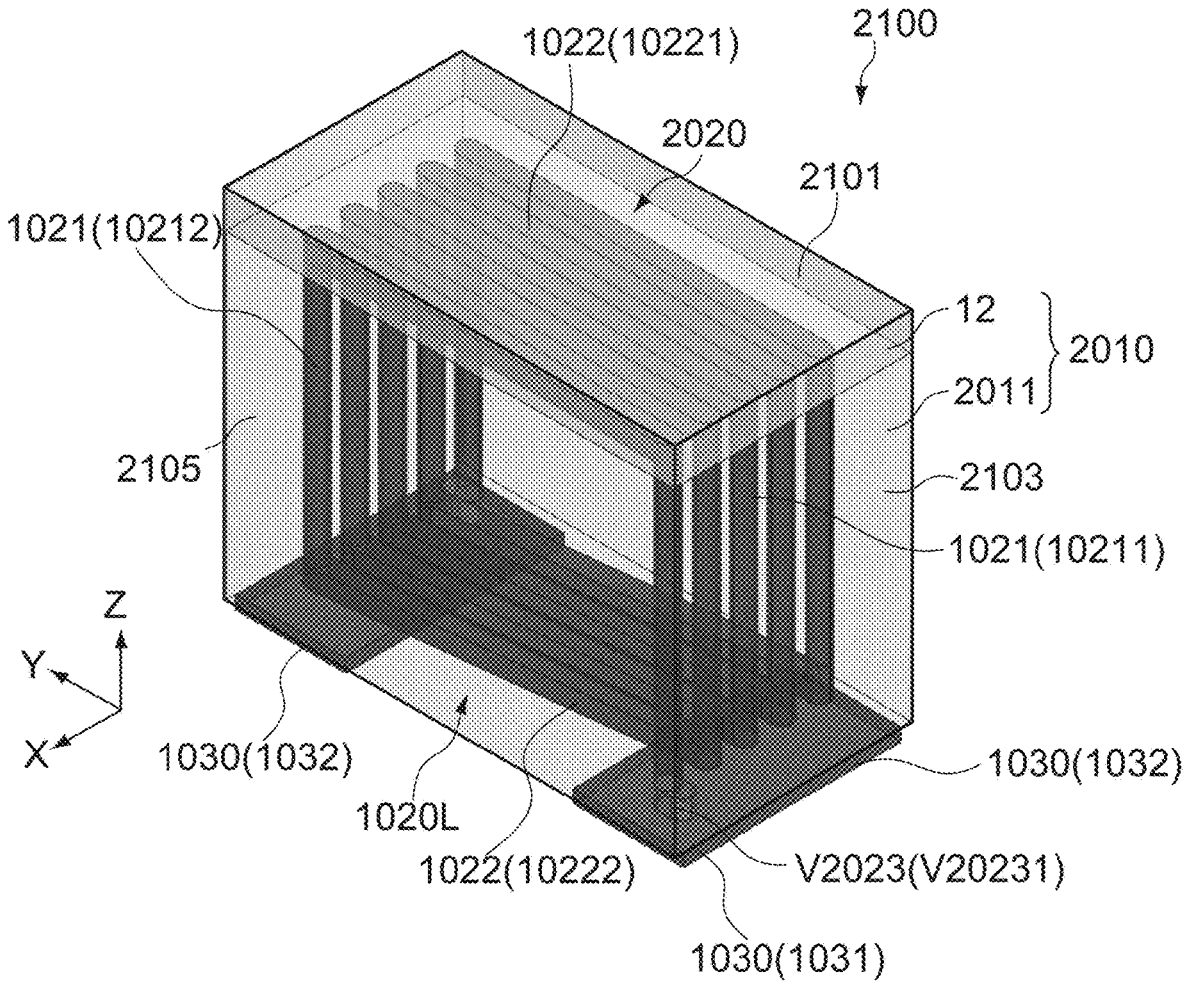
FIG. 17 is a schematic perspective view of an electronic component according to the second arrangement of another embodiment of the disclosure.
Figure 18:
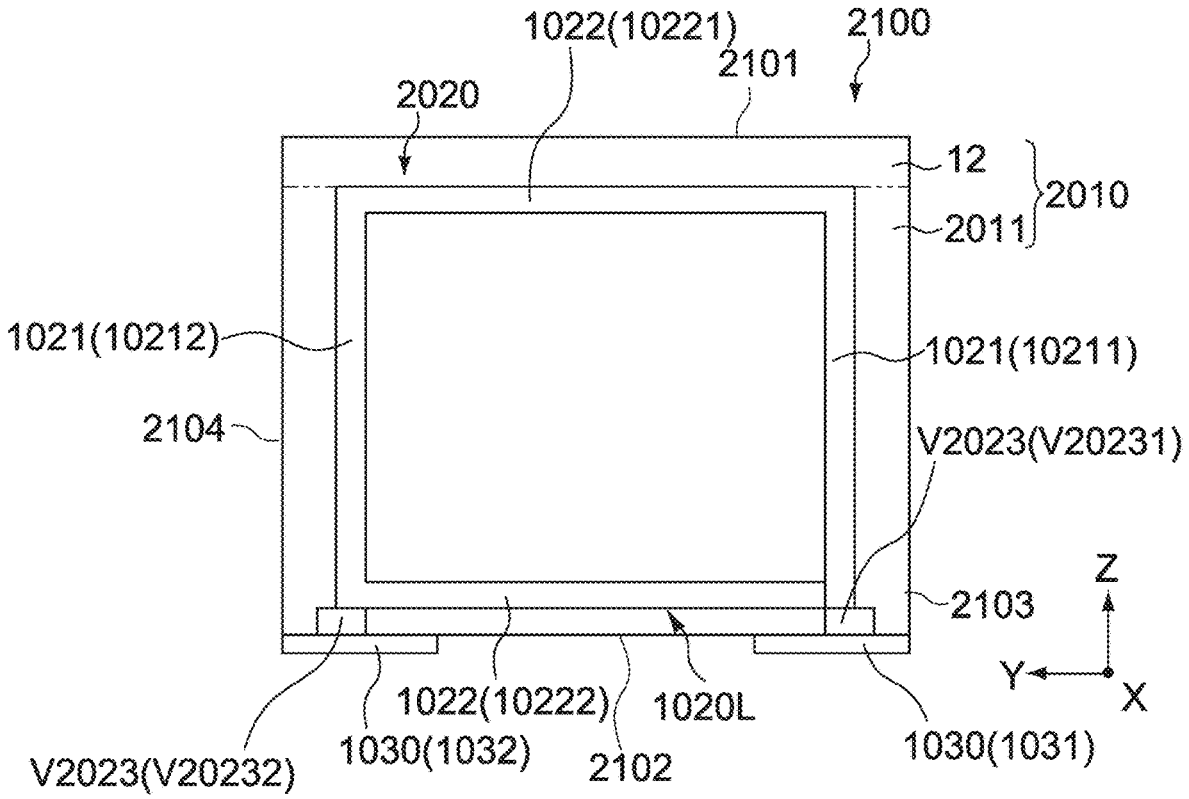
FIG. 18 is a schematic perspective side view of the electronic component of FIG. 17.
Figure 19:
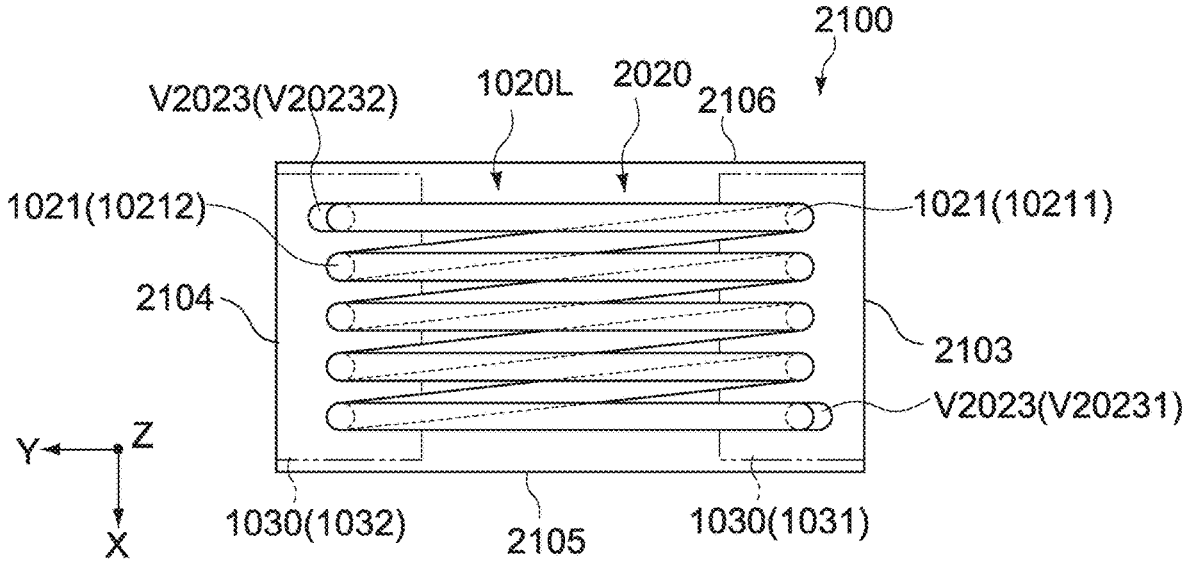
FIG. 19 is a schematic perspective top view of the electronic component of FIG. 17.

Next, the electronic components according to the second arrangement will be described with reference to FIGS. 17-19. FIG. 17 is a schematic perspective view of an electronic component according to the second arrangement. FIG. 18 is a schematic side view of the electronic component of FIG. 17. FIG. 19 is a schematic top view of the electronic component of FIG. 17.

An electronic component 2100 according to this arrangement may be configured as a coil component that is surface-mounted on a substrate. The electronic component 2100 may include an insulator 2010, an internal conductor 2020, and an external electrode 1030.

The insulator 2010 may include a body 2011 and an upper portion 12. The body 2011 may include the internal conductor 2020 thereinside and form a main part of the insulator 2010.

The insulator 2010 may include a top surface 2101, a bottom surface 2102, a first end surface 2103, a second end surface 2104, a first side surface 2105, and a second side surface 2106. The insulator 10 is made in a cuboid shape that has the width in the X-axial direction, the length in the Y-axial direction and the height in the Z-axial direction.

The internal conductor 2020 may be provided inside the insulator 2010. The internal conductor 2020 may include a plurality of pillared conductive members 1021 and a plurality of connecting conductive members 1022. The plurality of pillared conductive members 1021 and the plurality of connecting conductive members 1022 together form a coil portion 1020L. The plurality of connecting via conductive layers V2023 may be connected to the both ends of the coil portion 1020L, respectively.

The connecting via conductive layers V2023 include first connecting via conductive layer V20231 and second connecting via conductive layer V20232. The first connecting via conductive layer V20231 may be coupled to a lower end of the first pillared conductive member 10211 that forms one end of the coil portion 1020L, and the second connecting via conductive layer V20232 may be coupled to a lower end of the second pillared conductive member 10212 that forms the other end of the coil portion 1020L. The first and second connecting via conductive layers V20231 and V20232 each have a oval cross-sectional shape along the plane orthogonal to the Z-axial direction. The cross section of the first and second connecting via conductive layers V20231 and V20232 each have an area larger than that of the pillared conductive member 1021. In other words, when the pillared conductive member 1021 and the connecting via conductive layers V2023 are projected to the XY plane, the substantially circular projection of the pillared conductive member 1021 is entirely included in the oval projection of the connecting via conductive layers V2023.

The external electrode 1030 may form an external terminal for surface mounting. The external electrode 30 may include first and second external electrodes 1031, 1032 that face to each other in the Y-axial direction. The first and second external electrodes 1031, 1032 may be formed only on the bottom surface 2102. The bottom surface 1102 is one of the surfaces of the insulator 2010.

As described above, the coil portion 1020L and the external electrodes 1030 may contact with each other in a larger area since the connecting via conductive layers V2023 each have a oval cross-sectional shape larger than that of the pillared conductive member 1021 that forms a part of the coil portion 1020L.

Third Arrangement

The coil components according to the above arrangements may include one or more dummy via conductive layers in the same layer as the connective via conductive layers V1023, V2023, as in the second arrangement described below. The dummy electrodes may be configured not to electrically connect the coil portion 1020L and the external electrodes 1030. A plurality of dummy via conductive layers may be formed in the insulator in contact with the external electrodes 1030. The dummy via conductive layers may increase the adhesion strength between the external electrodes 1030 and the insulator 1010. Such dummy via conductive layers are applicable to each of the above embodiments and above arrangements.

Figure 20:
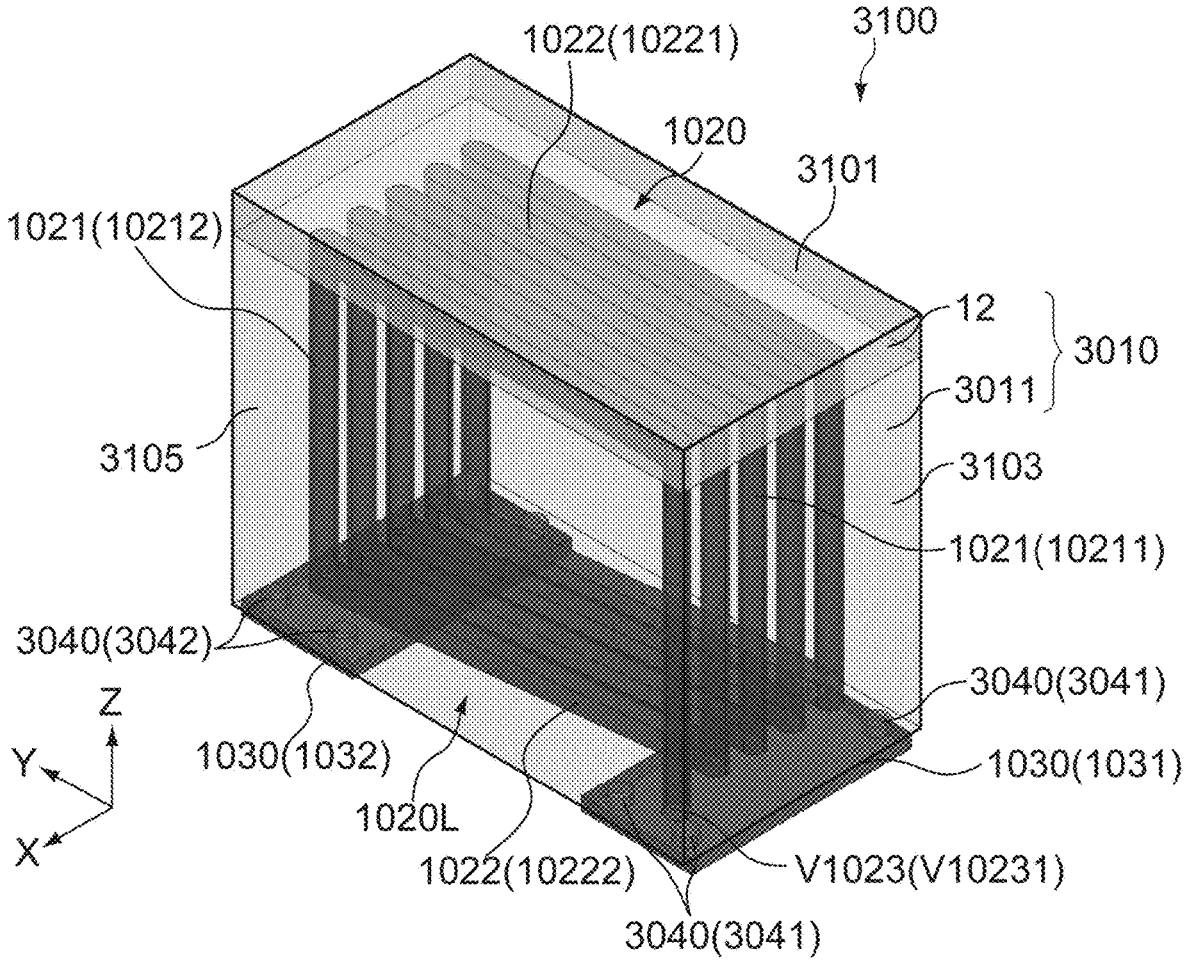
FIG. 20 is a schematic perspective view of an electronic component according to the third arrangement of another embodiment of the disclosure.
Figure 21:
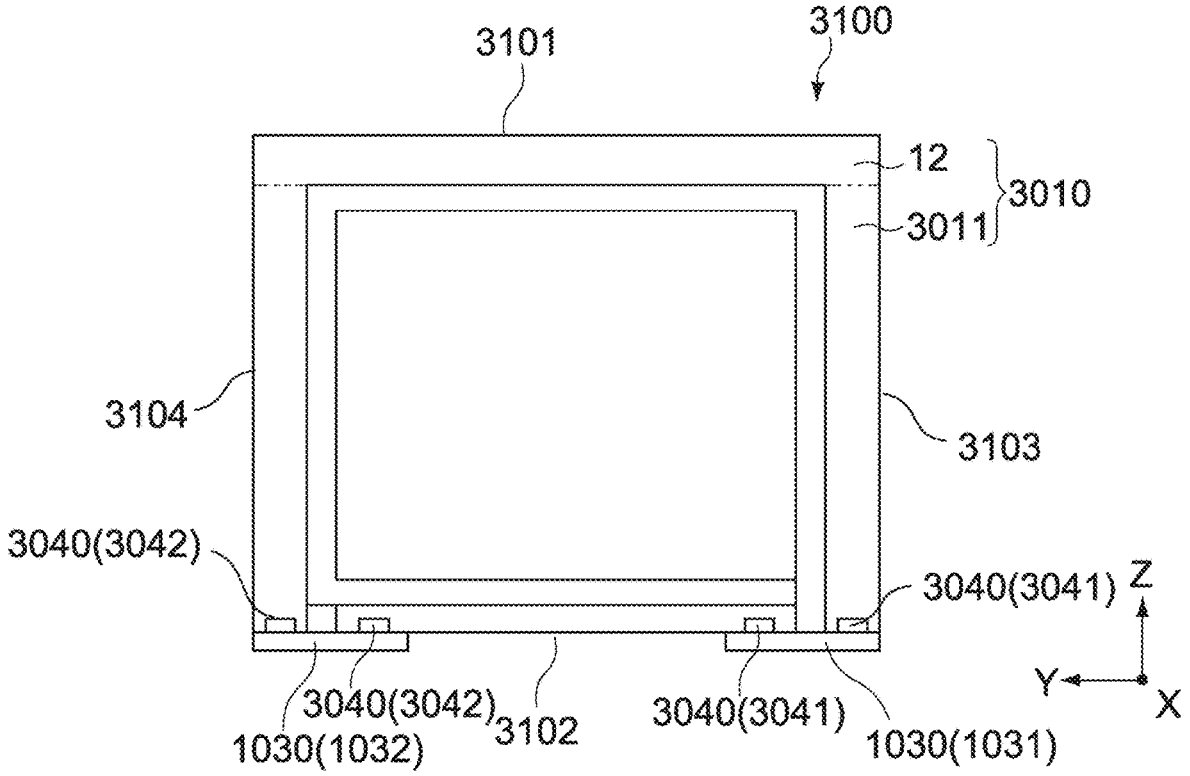
FIG. 21 is a schematic perspective side view of the electronic component of FIG. 20.
Figure 22:
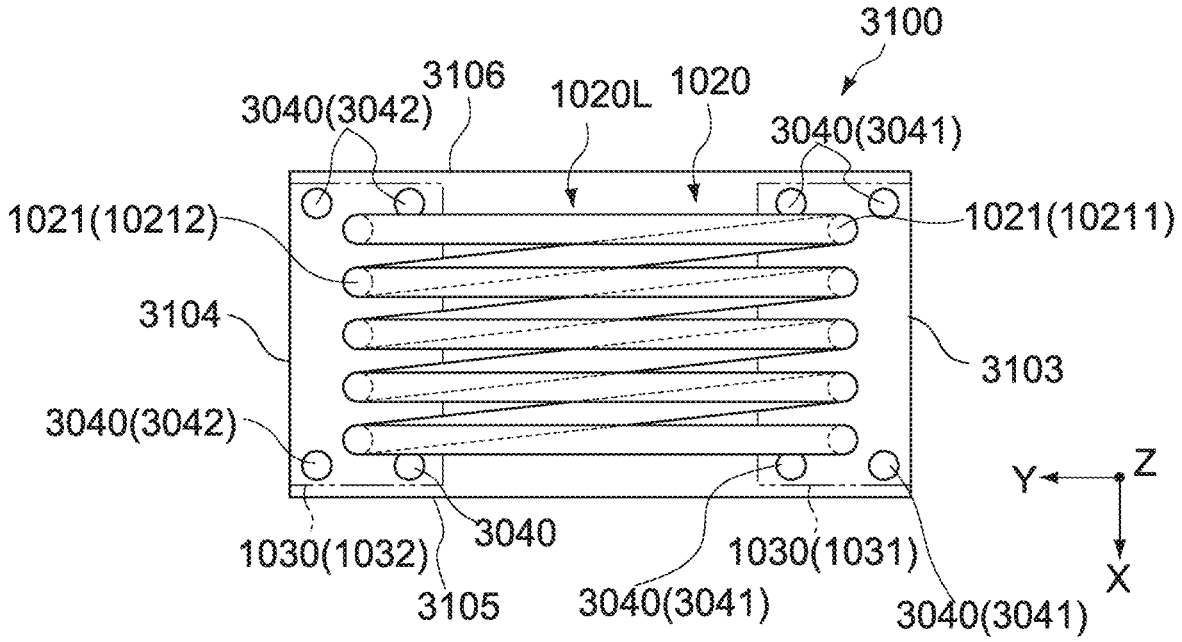
FIG. 22 is a schematic perspective top view of the electronic component of FIG. 20.

FIG. 20 is a schematic perspective view of an electronic component according to the third arrangement. FIG. 21 is a schematic side view of the electronic component of FIG. 20. FIG. 22 is a schematic top view of the electronic component of FIG. 20. The coil component according to the third arrangement include dummy via conductive layers in addition to the elements of the first arrangement. The same numerals are given to the same elements as those of the first arrangement, and the description thereof will be omitted.

An electronic component 3100 according to this arrangement may be configured as a coil component that is surface-mounted on a substrate. The electronic component 3100 may include an insulator 3010, an internal conductor 1020, and an external electrode 1030.

The insulator 3010 may include a body 3011 and an upper portion 12. The body 3011 may include the internal conductor 1020 and dummy via conductive layers 3040 and form a main part of the insulator 3010.

The insulator 3010 may include a top surface 3101, a bottom surface 3102, a first end surface 3103, a second end surface 3104, a first side surface 3105, and a second side surface 3106. The insulator 10 is made in a cuboid shape that has the width in the X-axial direction, the length in the Y-axial direction and the height in the Z-axial direction.

The dummy via conductive layers 3040 may be formed of a plurality of projections provided on the internal surface of the external electrodes 1030 that face the bottom surface 3102 of the rectangular insulator 3010. As shown in FIG. 21, the plurality of projections are each configured to penetrate the bottom surface 3102 into the insulator 3010. The tip ends of the dummy via conductive layers 3040 each face the internal conductor 1020 via the insulating material of the insulator 3010. Accordingly, tip ends of the dummy via conductive layers 3040 does not contact with the coil portion 1020L.

The dummy via conductive layers 3040 may be formed in the same layer as the connecting via conductive layers V1023. The plurality of dummy via conductive layers 3040 may include two groups of the conductive layers that are arranged so as to face to each other in the Y-axial direction. The first dummy via conductive layers 3041 form one group of the two conductive layers. The first dummy via conductive layers 3041 may be provided in the four corners of the first external electrode 1031 having a rectangular shape in the XY plane. The first dummy via conductive layers 3042 form the other group of the two conductive layers. The second dummy via conductive layers 3042 may be provided in the four corners of the second external electrode 1032 having a rectangular shape in the XY plane. The dummy via conductive layers 3040 are electrically insulated from the internal conductor 1020 by the insulating layer forming the insulator 3011.

In this exemplary variation, the dummy via conductive layers 3030 may increase the adhesion strength between the external electrodes 1030 and the insulator 3011. The external electrodes 1030 may be produced, for example, by electroplating, subsequently to forming a seed layer and a resist pattern having an opening in a similar manner to the production of the conductive pattern of the internal conductor in the above embodiment. The production process of the external electrodes 1030 may cause the dummy via conductive layers 3040 to be firmly adhered to the external electrodes 1030, thereby increasing the adhesion strength between the external electrodes 1030 and the insulator 3011.

Electronic Component Characteristics

Figure 23A:
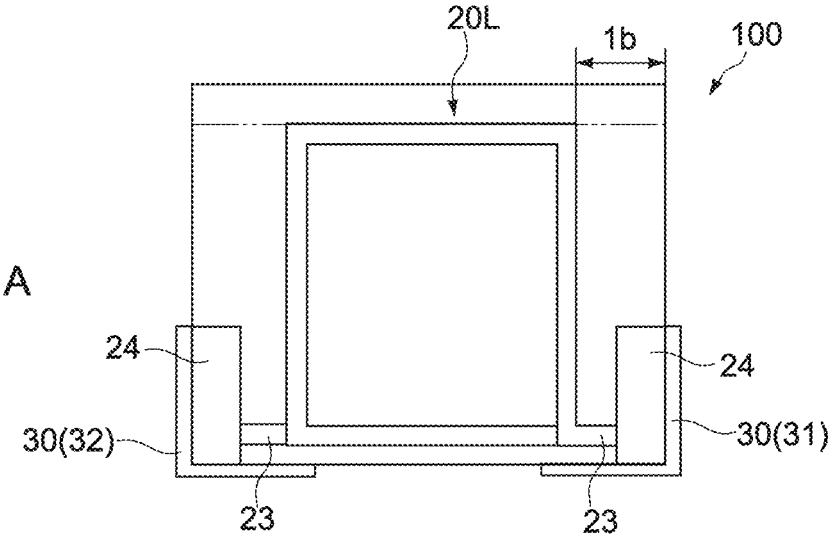
FIG. 23A is a schematic perspective view of an electronic component according to an embodiment of the disclosure.
Figure 23B:
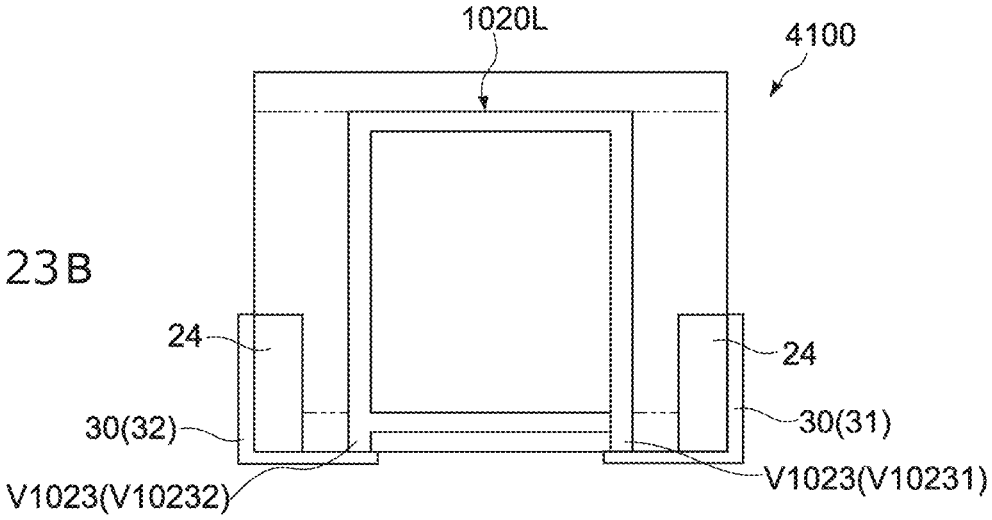
FIG. 23B is a schematic perspective view of an exemplary variation of the electronic component 100.
Figure 23C:
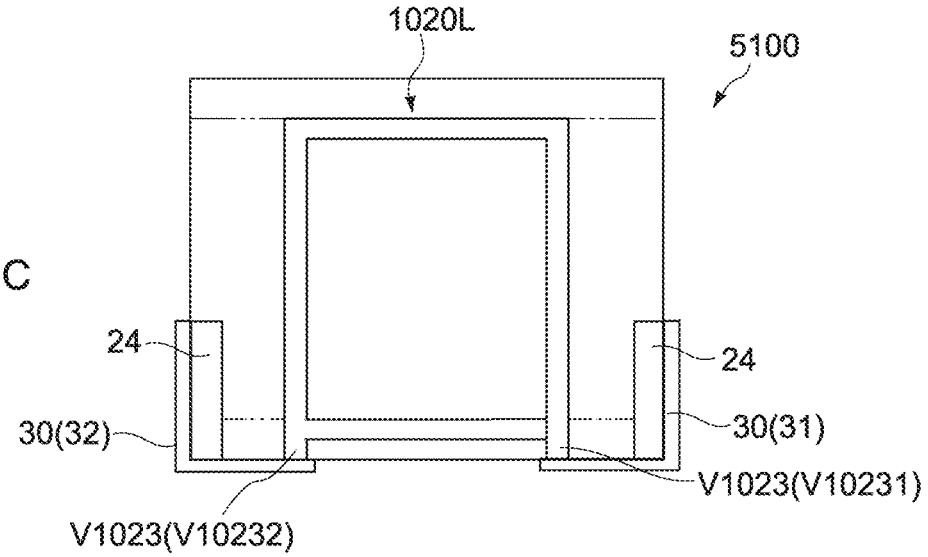
FIG. 23C is a schematic perspective view of another exemplary variation of the electronic component 100.
Figure 24A:
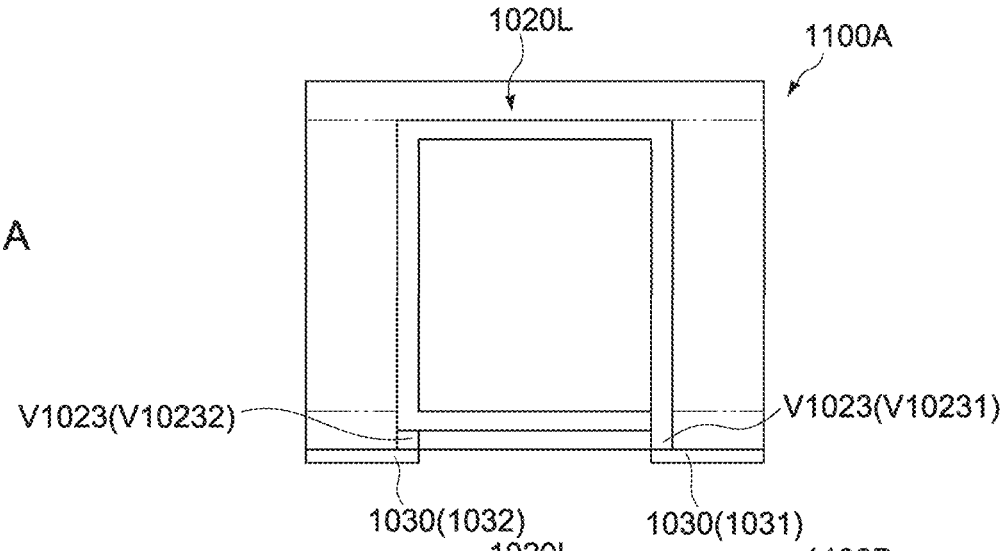
FIGS. 24A-24C each illustrate an electronic component corresponding to the electronic component 1100 according to the second embodiment.

The present invention is not limited to the above embodiments, but may be configured as shown in FIGS. 23 and 24. FIGS. 23 and 24 are schematic perspective views of the electronic components according to the above embodiments. FIGS. 23A-23C each illustrate an electronic component having the comb-tooth block portions 24. FIGS. 24A-24 C each illustrate an electronic component that does not have the comb-tooth block portions 24. The same numerals are given to the same elements as those of the above embodiments.

The electronic components in FIG. 23 and FIG. 24 each have the same external dimensions. The ratio (Ha/La) of the height (Ha) to the length (La) of the insulator is 1.5 times or less of the ratio (hd/ld) of the height (hd) between the inner peripheral portions of the circumference section Cn along the Z-axial direction with respect to the length (ld) between the inner peripheral portions of the circumference section Cn along the Y-axial direction.

FIG. 23A is a schematic perspective view of the electronic component 100 according to the first embodiment. FIG. 23B is a schematic perspective view of the electronic component 4100. according to the first embodiment. Unlike the electronic component 100, the electronic component 4100 does not include the extended portion 23. The electronic component 4100 is configured such that the external electrodes 20 and the coil portion 1020L are connected through the connecting via conductive layers V1023 like the second embodiment. FIG. 23C is a schematic perspective view of the electronic component 5100 in which the comb-tooth block portions 24 is shorter in the Y-axial direction and thus the distance between the coil portion 1020L and the comb-tooth block portions 24 is larger as compared to the electronic component 3100 shown in FIG. 23B. The side margin (lb) between the coil portion 20L and the end surface of the insulator in the Y-axial direction (left-right direction) is 45 μm in each of the electronic components in FIGS. 23A-23C.

Figure 24B:
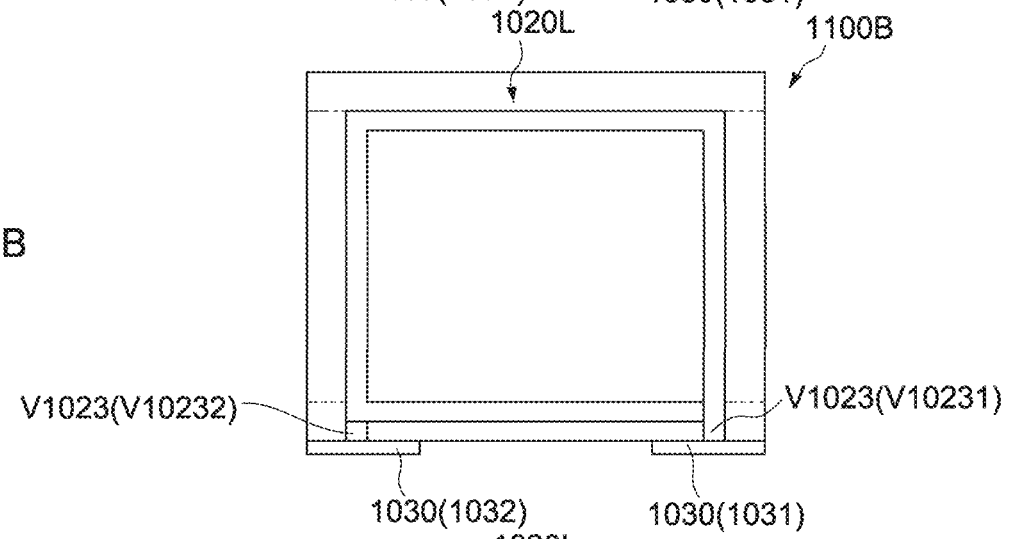
Figure 24C:
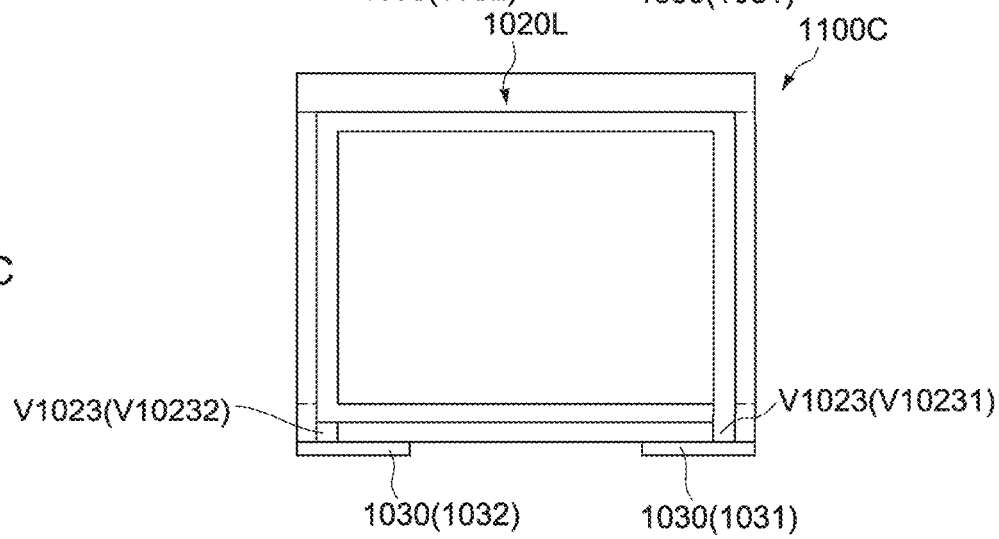

FIGS. 24A-24C each illustrate an electronic component corresponding to the electronic component 1100 according to the second embodiment (the first arrangement). Their fundamental configurations are same except for the side margins (1b) in the Y-axial direction. The side margin 1b of the electronic component 1100A shown in FIG. 24A is 45μm. The side margin 1b of the electronic component 1100B shown in FIG. 24B is 20 μm. The side margin 1b of the electronic component 1100C shown in FIG. 24C is 10 μm.

Figure 25:
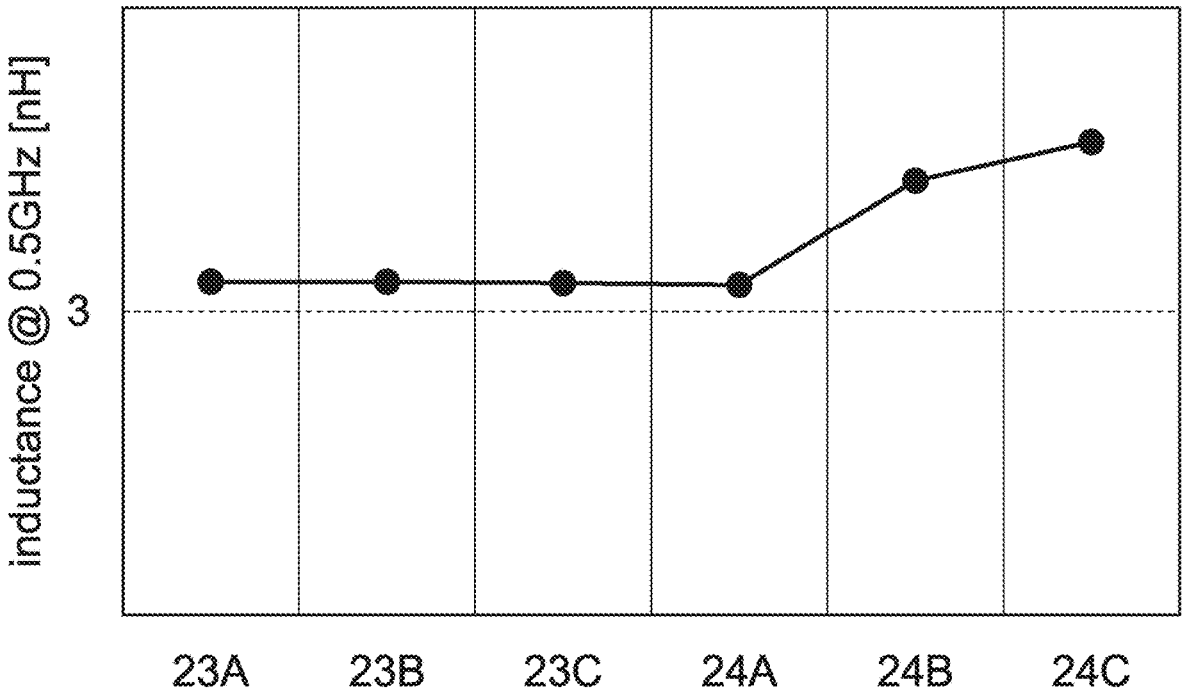
FIG. 25 shows the inductance (L value) properties of each of the electronic components illustrated in FIGS. 23A-23C and FIGS. 24A-24C.
Figure 26:
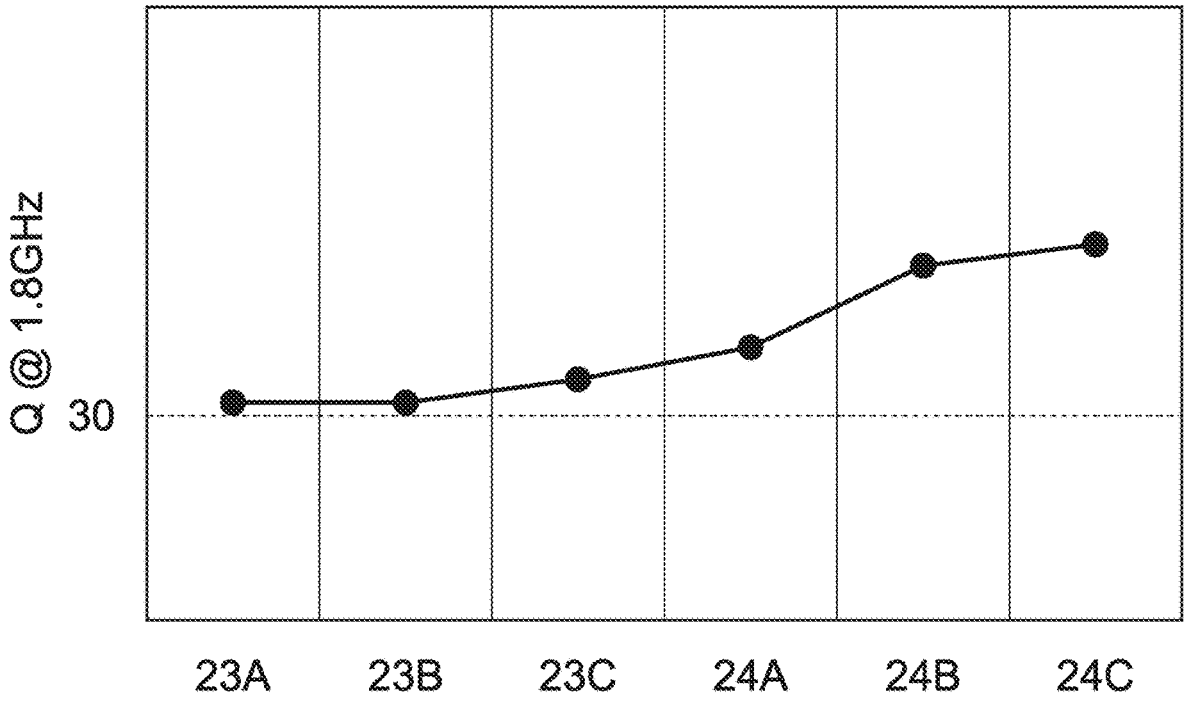
FIG. 26 shows the Q value properties of each of the electronic components illustrated in FIGS. 23A-23C and FIGS. 24A-24C.

FIG. 25 shows the inductance (L value) properties of each of the electronic components illustrated in FIGS. 23A-23C and FIGS. 24A-24C. FIG. 26 shows the Q value properties of each of the electronic components illustrated in FIGS. 23A-23C and FIGS. 24A-24C. In FIGS. 25 and 26, the numeral 23A, 23B, 23C, 24A, 24B, and 24C in the abscissa each indicate the electronic components illustrated in FIGS. 23A, 23B, 23C, 24A, 24B, and 24C, respectively. In FIGS. 25 and 26, the inductances and Q values of each of those electronic components are plotted.

As shown in FIGS. 25 and 26, each of the electronic components has the L value of 3 nH or more and the Q value of 30 or more. Thus, those electronic components achieved such a high inductance value and Q value. The inductance properties and Q value properties may be further enhanced by enlarging the opening (core) of the coil portion.

Figure 27A:
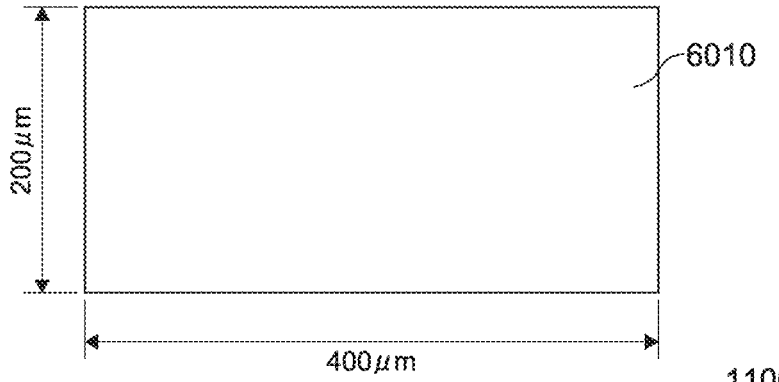
FIGS. 27A-27D are presented to compare the regions available for the internal conductors depending on the configurations of electronic components according to various embodiments of the present invention.
Figure 27B:
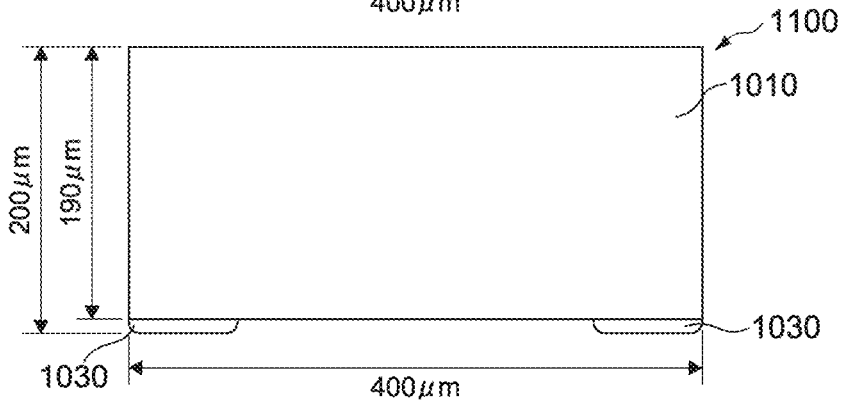
Figure 27C:
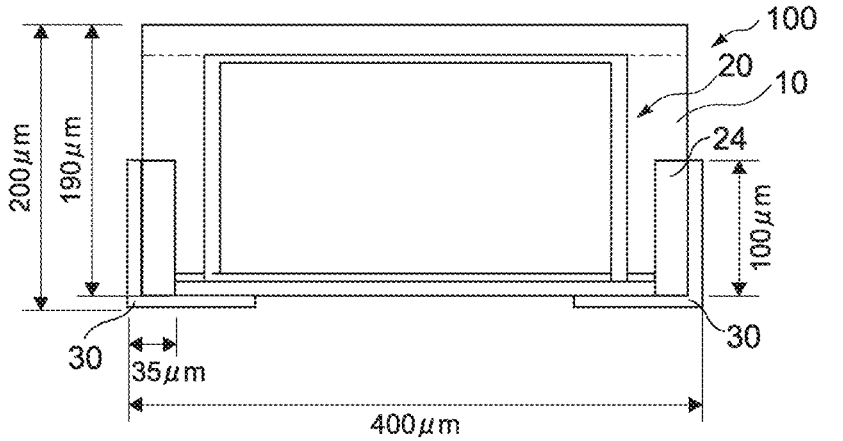
Figure 27D:
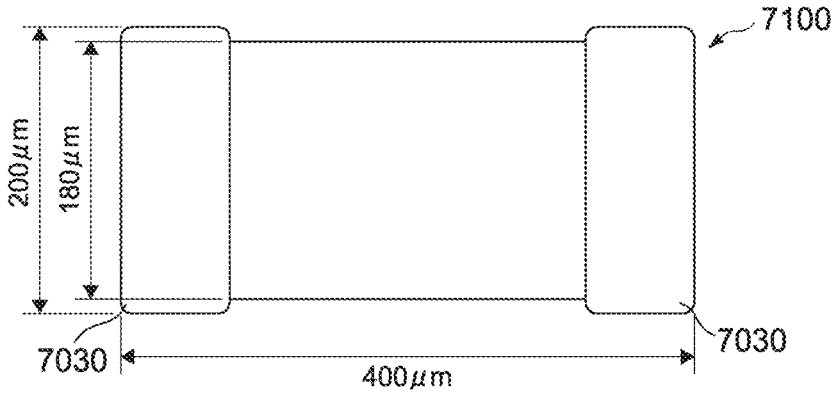

FIG. 27A-27D are presented to compare the regions available for the internal conductors depending on the configurations of electronic components. The electronic components in FIGS. 27A-27D each have the external dimensions of 200 μm (width)×400 μm (length)×200 μm (height). FIG. 27B is a schematic external side view of the single-surface-mounting type electronic component 1100 according to the second embodiment (first arrangement). FIG. 27C is a schematic perspective side view of the three-surface-mounting type electronic component 100 according to the first embodiment (first arrangement). FIG. 27D is a schematic external side view of a conventional five-surface-mounting type electronic component 7100. The numerals 7030 indicate external electrodes. In each of the electronic components, the external electrodes have the thickness of 10 μm. In the example shown in FIG. 27A, the external shape of the electronic component is identical that of the insulator thereof. As described below, the proportions of the insulators in the corresponding electronic components shown in FIGS. 27B-27D are calculated by setting the volume of the insulator 6010 to 100%.

The proportion of the insulator 1010 in the single-surface-mounting type electronic component 1100 as shown in FIG. 27B is 95%. The proportion of the insulator 10 in the three-surface-mounting type electronic component 100 as shown in FIG. 27C is 84%. The proportion of the insulator in the five-surface-mounting type electronic component 7100 as shown in FIG. 27D is 76.95%. As the proportion of the insulator in an electronic component increases, the area in the insulator in which an internal conductor can be arranged may be increased as well. Accordingly, the single-surface-mounting type electronic component 1100 and the three-surface-mounting type electronic component 100 each have a larger area available for the internal conductor as compared to the conventional five-surface-mounting type electronic component 7100, thereby enlarging the opening (core) of the coil portion. Thus, the L value and Q value may be enhanced.

What is claimed is:

1. A coil component comprising:

an insulator formed of a non-magnetic material, the insulator having a width direction in a first axial direction, a length direction in a second axial direction, a height direction in a third axial direction, and a mounting surface along the first axial direction and the second axial direction; and a coil portion being arranged inside the insulator, the coil portion including a circumference section, the circumference section being wound around the first axial direction and having a plurality of first conductor portions and a plurality of second conductor portions, each of the plurality of first conductor portions extending along the third axial direction, one of the plurality of second conductor portions connecting one of the plurality of first conductor portions and another of the plurality of first conductor portions disposed apart from the one of the plurality of first conductor portions in the first axial direction, a longitudinal direction of said one of the plurality of second conductor portions extending in a direction intersecting a plane orthogonal to the first axial direction, wherein a first ratio of a height to a length of the insulator is equal to or less than 1.4 times a second ratio of a height between first inner peripheral portions of the circumference section along the third axial direction with respect to a length between second inner peripheral portions of the circumference section along the second axial direction.

2. The coil component of claim 1, wherein the second ratio is 0.6 to 1.0.

3. The coil component of claim 1, wherein a third ratio of a first area partitioned by the first and second inner peripheral portions of the circumferential section with respect to a second area of the insulator portion as viewed from the first axial direction is 0.22 to 0.45.

4. The coil component of claim 1, wherein the insulator is formed of a ceramic material or a resin material.

5. The coil component of claim 1, wherein a third ratio of a first area partitioned by the first and second inner peripheral portions of the circumferential section with respect to a second area of the insulator portion as viewed from the first axial direction is 0.22 to 0.65.

6. The coil component of claim 5, wherein the insulator is formed of a ceramic material or resin material.

7. The coil component of claim 1, wherein the insulator is formed into a cuboid shape; and the coil component further comprising a plurality of external electrodes electrically connected to the coil portion, each of the plurality of external electrodes is provided only on one particular surface of the insulator.

8. The coil component of claim 7, wherein the coil portion and each of the plurality of external electrodes are electrically connected through a connecting via conductive member, the connecting via conductive member being connected to one end of the coil portion.

9. The coil component of claim 8, wherein a cross section of the connecting via conductive member orthogonal to the third axial direction is larger than a cross section of said one end of the coil portion orthogonal to the third axial direction.

10. The coil component of claim 7, wherein the plurality of external electrodes each include an inner surface facing said one particular surface of the insulator and a plurality of projections, the projections being formed on the inner surface and penetrating said one particular surface.

* * * * *